US007728810B2

(12) United States Patent
You et al.

(10) Patent No.: US 7,728,810 B2
(45) Date of Patent: Jun. 1, 2010

(54) DISPLAY DEVICE AND METHOD FOR DRIVING THE SAME

(75) Inventors: Sook Kyung You, Seoul (KR); Ha Young Ji, Chungcheongbuk-do (KR); Jin Ho Kim, Gyeongsangbuk-do (KR); Dong Hoon Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1081 days.

(21) Appl. No.: 11/376,107

(22) Filed: Mar. 16, 2006

(65) Prior Publication Data

US 2007/0120810 A1 May 31, 2007

(30) Foreign Application Priority Data

Nov. 28, 2005 (KR) ..... 10-2005-0114304
Dec. 7, 2005 (KR) ..... 10-2005-0118874
Mar. 7, 2006 (KR) ..... 10-2006-0021317

(51) Int. Cl.
*G09G 3/36* (2006.01)

(52) U.S. Cl. ..... 345/103; 349/139

(58) Field of Classification Search ..... 345/103
See application file for complete search history.

(56) References Cited

U.S. PATENT DOCUMENTS

2001/0054939 A1* 12/2001 Zhu et al. ..... 333/33
2002/0196220 A1* 12/2002 Sato et al. ..... 345/87
2003/0011549 A1* 1/2003 Murahashi et al. ..... 345/87
2005/0007522 A1* 1/2005 Hiraga et al. ..... 349/106
2005/0073474 A1* 4/2005 Kim et al. ..... 345/55
2005/0104822 A1* 5/2005 Seki ..... 345/82
2006/0007075 A1* 1/2006 Adachi et al. ..... 345/76
2007/0057904 A1* 3/2007 Huang et al. ..... 345/103

* cited by examiner

*Primary Examiner*—Sumati Lefkowitz
*Assistant Examiner*—Alonso Tapia
(74) *Attorney, Agent, or Firm*—Holland & Knight LLP

(57) ABSTRACT

A display device includes a plurality of pixel cells divided into at least a first pixel cell group and a second pixel cell group; a first data line electrically connected to the pixel cells in the first pixel cell group, and a second data line electrically connected to the pixel cells in the second pixel cell group; and a gate driver driving at least one of the pixel cells in the first pixel cell group concurrently with at least one of the pixel cells in the second pixel cell group.

21 Claims, 15 Drawing Sheets

DISPLAY DEVICE AND METHOD FOR DRIVING THE SAME

This application claims the benefit of the Korean Patent Application No. 2005-0114304, filed on Nov. 28, 2005, No. 2005-0118874, filed on Dec. 7, 2005, and No. 2006-0021317, filed on Mar. 7, 2006, all three of which are hereby incorporated by reference in their entirety.

BACKGROUND OF THE INVENTION

1. Field of the Invention

The present invention relates to a display device, and more particularly, to a pixel cell in a display device and a method for driving the same.

2. Discussion of the Related Art

Recently, various flat panel displays having relatively lighter and less spacious than cathode ray tubes (CRT) have been developed. Examples of such flat panel displays include a liquid crystal display (LCD) device, a field emission display (FED), a plasma display panel (PDP), and a light emitting display (LED).

In particular, the LCD device includes a thin film transistor substrate, a color filter substrate, and a liquid crystal layer. The thin film transistor substrate includes a plurality of liquid crystal cells arranged in respective regions defined by a plurality of data lines and a plurality of gate lines. A plurality of thin film transistors serving as switching elements are formed in the respective liquid crystal cells. The color filter substrate includes a color filter layer. Then, the liquid crystal layer is formed between the thin film transistor substrate and the color filter substrate.

The LCD device displays color images using light transmitted through the thin film transistor substrate and the color filter substrate. In this respect, a color realization ratio of the LCD device may be lowered due to the characteristics of color filter. To solve the problem of the low color realization ratio of the LCD device, a field sequential color (hereinafter referred to as an FSC) LCD device has been proposed.

FIG. 1 illustrates an operation of a FSC LCD device according to the related art. As shown in FIG. 1, in the related art FSC LCD device, one frame period, or frame, is divided into three sub frames by time division. Red(R), green(G) and blue(B) colors are mixed in each of the sub frames to display color images. For example, when one frame of the related art FSC LCD device is time-divided into the three sub frames, red(R) light of the first sub frame, green(G) light of the second sub frame, and blue(B) light of the third sub frame are color-mixed at a predetermined ratio to display color images.

With the recent trend of large-size display devices, the number of gate lines increases. Accordingly, a driving time for each gate line decreases. Specifically, the display device necessarily drives all gate lines during a preset time period during one frame. As the number of gate lines increases, a scan time for each gate line decreases. Thus, a turn-on time of a thin film transistor connected to each gate line decreases in accordance with the decrease in the scan time of the gate lines.

Due to the short scan time, the related art FSC LCD device can hardly charge a sufficient voltage at each gate line. To solve this problem, the size of the thin film transistor has been increased. However, design rules restrict the size of the thin film transistor.

SUMMARY OF THE INVENTION

Accordingly, the present invention is directed to a display device and a method for driving the same, which substantially obviate one or more problems due to limitations and disadvantages of the related art.

An object of the present invention is to provide a display device, and a method for driving the same, that provide a sufficient charge time for each pixel cell.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a display device includes a plurality of pixel cells divided into at least a first pixel cell group and a second pixel cell group; a first data line electrically connected to the pixel cells in the first pixel cell group, and a second data line electrically connected to the pixel cells in the second pixel cell group; and a gate driver driving at least one of the pixel cells in the first pixel cell group concurrently with at least one of the pixel cells in the second pixel cell group.

In another aspect, a display device includes a plurality of pixel cells divided into at least a first pixel cell group and a second pixel cell group; a data driver supplying data to the respective pixel cells in the first and second pixel cell groups; and a gate driver driving the pixel cells in the first pixel cell group sequentially according to an order of the pixel cells in the first pixel cell group from a first one to a last one of the pixel cells in the first pixel cell group, and driving the pixel cells in the second pixel cell group sequentially according to a reverse order of the pixel cells in the second pixel cell group from a last one to a first one of the pixel cells in the second pixel cell group.

In another aspect, a display device includes a plurality of pixel cells divided into at least a first pixel cell group and a second pixel cell group; a data driver supplying data to the respective pixel cells in the first and second pixel cell groups; and a gate driver driving the pixel cells in the first pixel cell group sequentially according to an order of the pixel cells in the first pixel cell group from a first one to a last one of the pixel cells in the first pixel cell group, and driving the pixel cells in the second pixel cell group sequentially according to an order of the pixel cells in the second pixel cell group from a first one to a last one of the pixel cells in the second pixel cell group.

In another aspect, a method for driving a display device including a plurality of pixel cells divided into at least a first pixel cell group and a second pixel cell group, and a first data line electrically connected to the pixel cells in the first pixel cell group, and a second data line electrically connected to the pixel cells in the second pixel cell group but not electrically connected to the pixel cells in the first pixel cell group, includes driving at least one of the pixel cells in the first pixel cell group concurrently with at least one of the pixel cells in the second pixel cell group.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
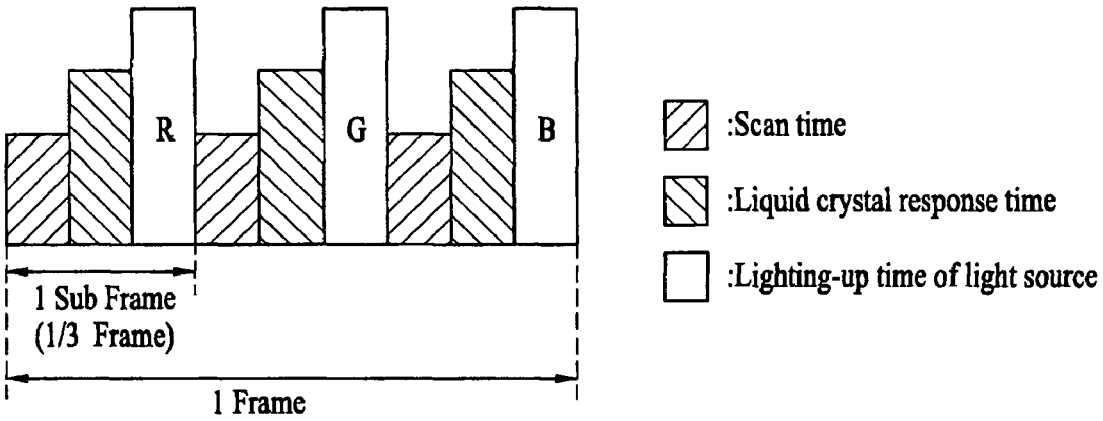
FIG. 1 Related Art
FIG. 1 illustrates an operation of a FSC LCD device according to the related art.
Figure 2:
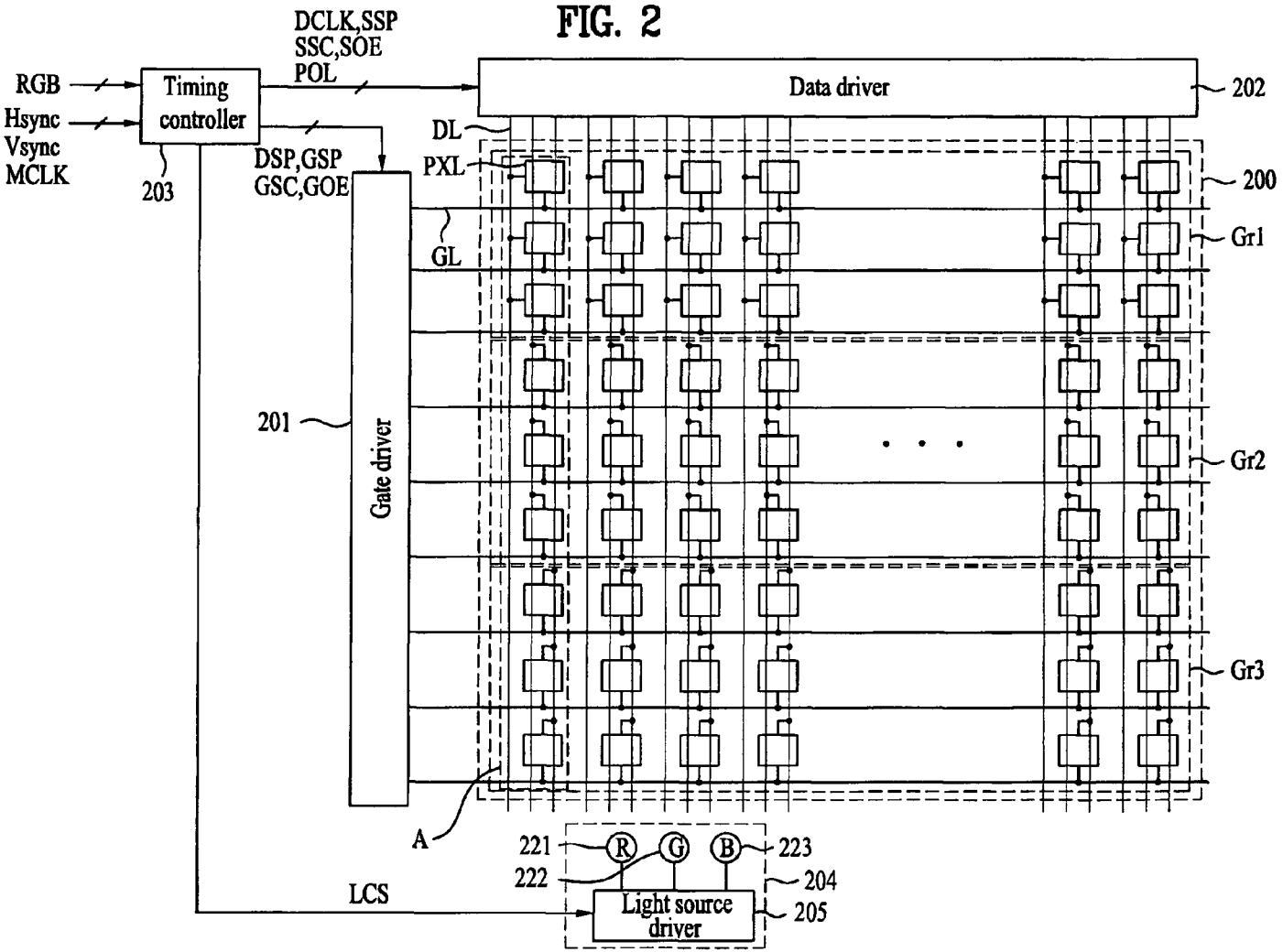
FIG. 2 shows a schematic diagram of an exemplary LCD device according to an embodiment of the present invention.

FIG. 2 shows a schematic diagram of an exemplary LCD device according to an embodiment of the present invention. Referring to FIG. 2, an LCD device includes a display unit 200, a backlight unit 204, a data driver 202, a gate driver 201, and a timing controller 203. The display unit 200 includes pixel cells PXL respectively formed in regions defined by crossings of a plurality of gate lines GL with a plurality of data lines DL. The backlight unit 204 sequentially emits green, red and blue light colors to the display unit 200. The data driver 202 supplies data to the data lines DL of the display unit 200 by time-dividing one frame into a plurality of sub frames. The gate driver 201 drives the gate lines GL of the display unit 200. The timing controller 203 controls the data driver 202, the gate driver 201, and the backlight unit 204.

The timing controller 203 generates data control signals (DCS) and gate control signals (GCS) using horizontal synchronizing signals (Hsync), vertical synchronizing signals (Vsync), and a main clock (MCLK) externally inputted. Also, the timing controller 203 generates light source control signals LCS for sequentially driving red, green, and blue light sources 221, 222, and 223 during one frame period by using the horizontal synchronizing signals Hsync, vertical synchronizing signals Vsync, and the input main clock MCLK. Then, the timing controller 203 supplies the light source control signals LCS to the backlight unit 204.

The DCS data control signals include a dot clock (DCLK), a source start pulse (SSP), a source shift clock (SSC), a source output enable (SOE), and a polarity control signal (POL). The gate control signals (GCS) include a gate start pulse (GSP), a gate shift clock (GSC), and a gate output enable (GOE).

The timing controller 203 re-aligns externally input source data R, G, and B to be suitable for a field sequential color FSC driving method in an order of R data, G data and B data. Then, the timing controller 203 supplies the aligned R, G and B data in the respective sub frames of the frame period to the data driver 202.

The gate driver 201 includes a shift register (not shown) and a level shifter (not shown). The shift register generates scan pulses in response to the gate control signal GCS and the gate start pulse GSP from the timing controller 203. The level shifter shifts the voltage of scan pulse to be suitable for driving of the pixel cell PXL. The gate driver 201 sequentially shifts the gate start pulse GSP supplied from the timing controller 203 according to the gate shift clock GSC, and supplies the scan pulses to the gate lines GL during each sub frame. The gate driver 201 simultaneously drives at least two gate lines GL.

The data driver 202 samples the data supplied from the timing controller 203 according to the data control signal DCS from the timing controller 203. Then, the data driver 202 latches the sampled data to corresponding lines, converts the latched data to analog data corresponding to gamma voltages, and supplies the analog data to the data lines DL. Accordingly, during a frame period, the data driver 202 supplies the red data during the first sub frame to the data lines DL, subsequently supplies the green data during the second sub frame to the data lines DL, and subsequently supplies the blue data during the third sub frame to the data lines DL.

The backlight unit 204 includes a red light source 221 for emitting a red R light to the display unit 200, a green light source 222 for emitting a green G light to the display unit 200, a blue light source 223 for emitting a blue B light to the display unit 200, and a light source driver 205 for driving the red, green and blue light sources 221, 222 and 223. The red, green and blue light sources 221, 222 and 223 respectively respond to signals from the light source driver 205, generate the red, green, and blue light during one frame period, and emit the generated light to the display unit 200. These red, green and blue light sources 221, 222 and 223 can be, for example, fluorescent lamps or light-emitting diodes.

The light source driver 205 responds to the light source control signals LCS from the timing controller 203, and sequentially drives the red, green, and blue light sources 221, 222 and 223, respectively, during the frame period. In response to the light source control signal LCS, the light source driver 205 drives the red light source 221 in a latter portion of the first sub frame, drives the green light source 222 in a latter portion of the second sub frame, and drives the blue light source 223 in the latter portion of the third sub frame.

Figure 3:
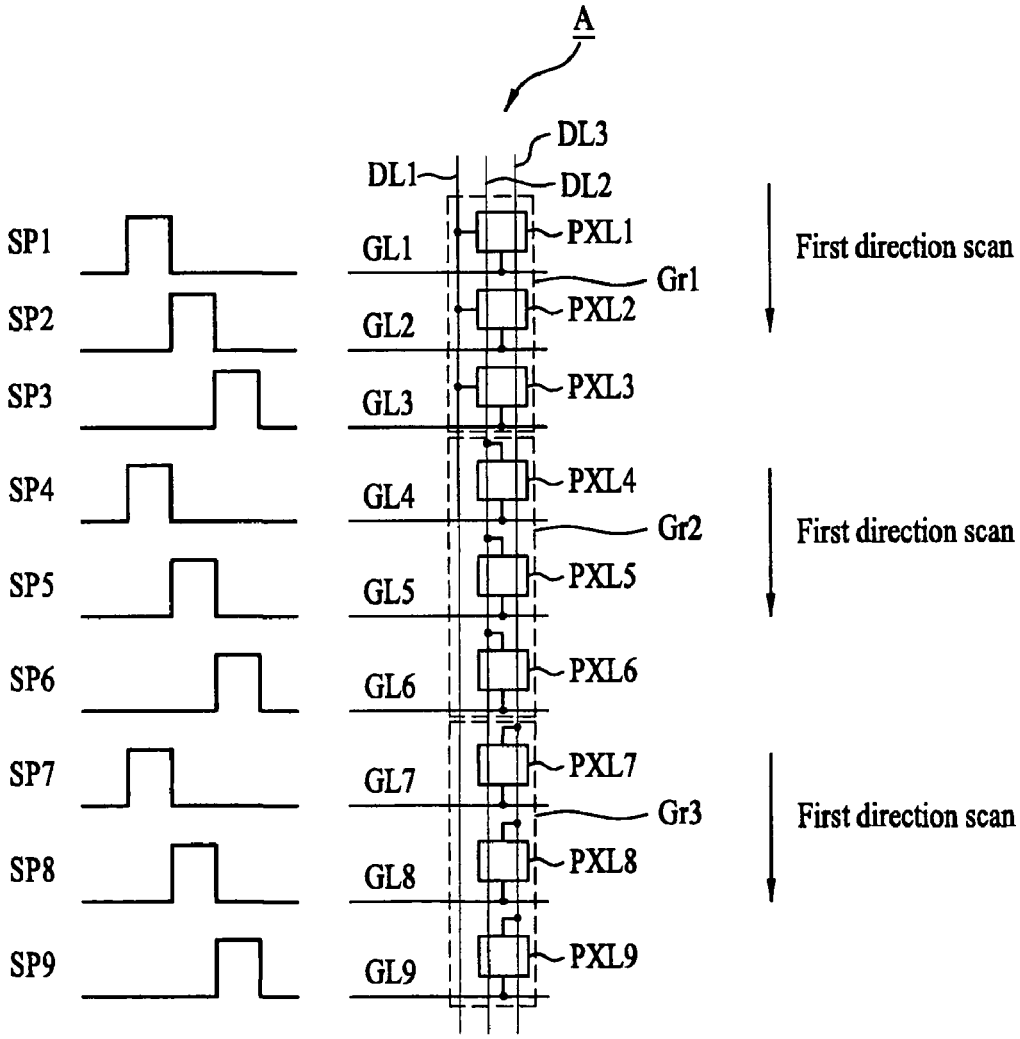
FIG. 3 shows a first exemplary scanning pattern along a column A pixel cells from the LCD device of FIG. 2.

FIG. 3 shows a first exemplary scanning pattern along a column A pixel cells from the LCD device of FIG. 2. In an embodiment of the present invention, the respective columns A of pixel cells have the same structure. For explanatory purposes, the exemplary column A of pixel cells is shown with nine pixel cells PXL divided into first to third pixel cell groups Gr1 to Gr3. Thus, each pixel cell group has three pixel cells PXL. The first pixel cell group Gr1 includes the first to third pixel cells PXL1 to PXL 3, the second pixel cell group Gr2 includes the fourth to sixth pixel cells PXL4 to PXL 6, and the third pixel cell group Gr3 includes the seventh to ninth pixel cells PXL7 to PXL9. The first to ninth gate lines GL1 to GL9 are respectively connected to the first to ninth pixel cells PXL1 to PXL9. The column A of pixel cells is electrically connected to three data lines DL1 to DL3. Thus, the number of pixel cell groups provided in one column A of pixel cells is equal to the number of data lines connected to the column A of the pixel cells.

In an embodiment of the present invention, the pixel cells PXL within one of the respective pixel cell groups Gr1 to Gr3 are electrically connected to the same data line. For example, the first data line DL1 is electrically connected to the first pixel cell PXL1, the second pixel cell PXL2, and the third pixel cell PXL3. The second data line DL2 is electrically connected to the fourth pixel cell PXL4, the fifth pixel cell PXL5, and the sixth pixel cell PXL6. The third data line DL3 is electrically connected to the seventh pixel cell PXL7, the eighth pixel cell PXL8, and the ninth pixel cell PXL9.

The gate lines GL1 to GL9 electrically connected to the pixel cells PXL in the respective pixel cell groups Gr1 to Gr3 are sequentially driven. In an embodiment, the n-th pixel cells ('n' is a natural number) of each pixel cell group are concurrently driven. Thus, the first gate line in a pixel cell group and the first gate line in the next pixel cell group are concurrently driven.

As shown in FIG. 3, the first to third gate lines GL1 to GL3 in the first pixel cell group Gr1 are sequentially driven according to the order of the pixel cells in the first pixel group Gr1. And, the fourth to sixth gate lines GL4 to GL6 in the second pixel cell group Gr2 are sequentially driven according to the order of the pixel cells in the second pixel cell group Gr2. Also, the seventh to ninth gate lines GL7 to GL9 in the third pixel cell group Gr1 are sequentially driven according to the order of the pixel cells in the third pixel cell group Gr3.

Thus, as shown in FIG. 3, the first to third gate lines GL1 to GL3 connected to the first to third pixel cells PXL1 to PXL3 in the first pixel cell group Gr1 are sequentially driven in a first scan direction by first to third scan pulses SP1 to SP3, respectively. For example, the first gate line GL1 is driven first by the first scan pulse SP1, the second gate line GL2 is driven second by the second scan pulse SP2, and the third gate line GL3 is driven third by the third scan pulse SP3. Accordingly, the first to third pixel cells PXL1 to PXL3 are sequentially driven at the first scan direction.

In the second pixel cell group Gr2, the fourth to sixth gate lines GL4 to GL6 connected to the fourth to sixth pixel cells PXL4 to PXL6 are sequentially driven in a first scan direction by the fourth to sixth scan pulses SP4 to SP6. The fourth to sixth pixel cells PXL4 to PXL6 are sequentially driven. For example, the fourth gate line GL4 is driven first by the fourth scan pulse SP4, the fifth gate line GL5 is driven second by the fifth scan pulse SP5, and the sixth gate line GL6 is driven third by the sixth scan pulse SP6. Accordingly, the fourth to sixth pixel cells PXL4 to PXL6 are sequentially driven in the first scan direction.

In the third pixel cell group Gr3, the seventh to ninth gate lines GL7 to GL9 connected to seventh to ninth pixel cells PXL7 to PXL9 are sequentially driven in a first scan direction by the seventh to ninth scan pulses SP7 to SP9. The seventh to ninth pixel cells PXL7 to PXL9 are sequentially driven. For example, the seventh gate line GL7 is driven first by the seventh scan pulse SP7, the eighth gate line GL8 is driven second by the eighth scan pulse SP8, and the ninth gate line GL9 is driven third by the ninth scan pulse SP9. Accordingly, the seventh to ninth pixel cells PXL7 to PXL9 are sequentially driven in the first scan direction.

In an embodiment, the first gate line GL1 connected to the first pixel cell PXL1, the fourth gate line GL4 connected to the fourth pixel cell PXL4, and the seventh gate line GL7 connected to the seventh pixel cell PXL7 are concurrently driven by the scan pulses SP1, SP4 and SP7. Also, the second gate line GL2 connected to the second pixel cell PXL2, the fifth gate line GL5 connected to the fifth pixel cell PXL5, and the eighth gate line GL8 connected to the eighth pixel cell PXL8 are concurrently driven by the scan pulses SP2, SP5 and SP8. Then, the third gate line GL3 connected to the third pixel cell PXL3, the sixth gate line GL6 connected to the sixth pixel cell PXL6, and the ninth gate line GL9 connected to the ninth pixel cell PXL9 are concurrently driven by the scan pulses SP3, SP6 and SP9.

The first scan pulse SP1 supplied to the first gate line GL1, the fourth scan pulse SP4 supplied to the fourth gate line GL4, and the seventh scan pulse SP7 supplied to the seventh gate line GL7 are outputted at the same time. The second scan pulse SP2 supplied to the second gate line GL2, the fifth scan pulse SP5 supplied to the fifth gate line GL5, and the eighth scan pulse SP8 supplied to the eighth gate line GL8 are outputted at the same time. The third scan pulse SP3 supplied to the third gate line GL3, the sixth scan pulse SP6 supplied to the sixth gate line GL6, and the ninth scan pulse SP9 supplied to the ninth gate line GL9 are outputted at the same time.

Figure 4A:
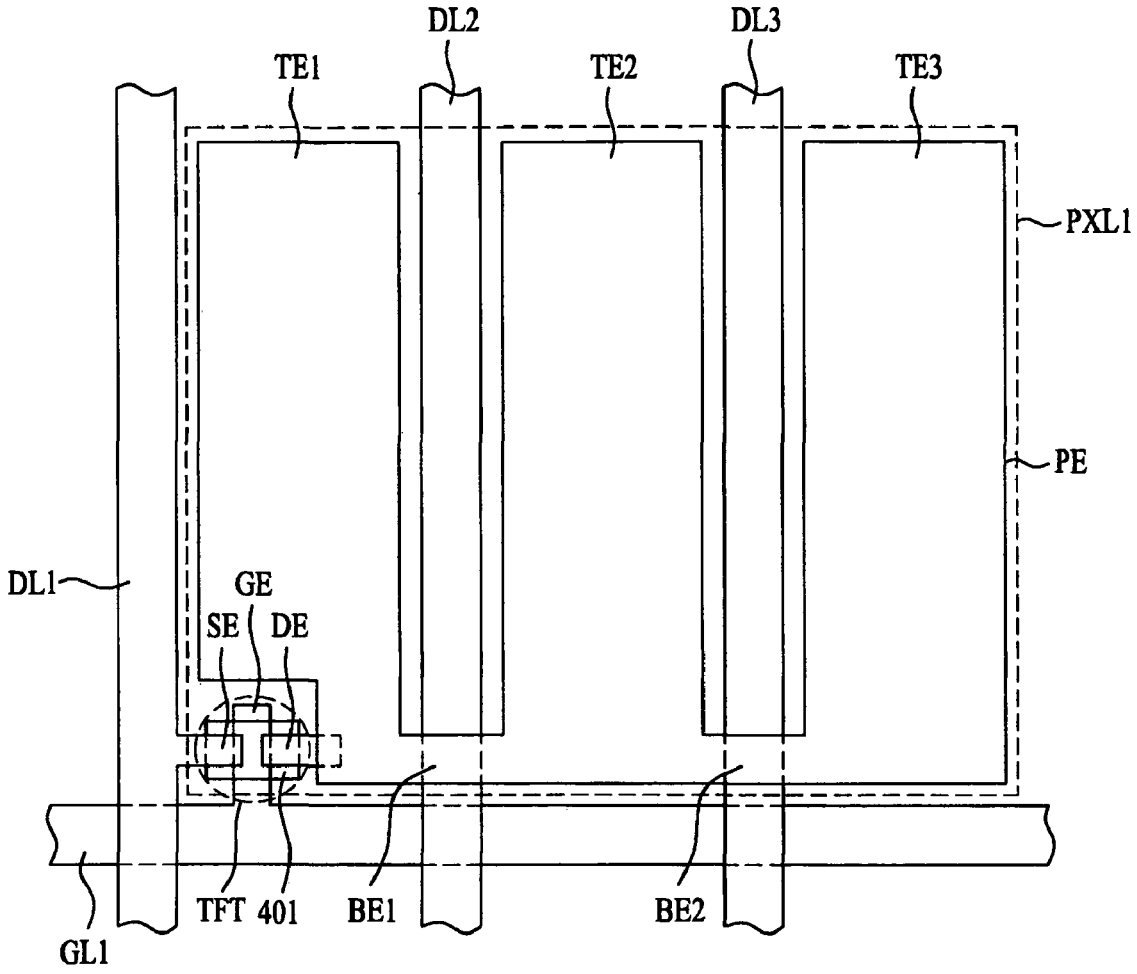
FIG. 4A shows an exemplary first pixel cell of the first pixel cell group of FIG. 3.

FIG. 4A shows an exemplary first pixel cell of the first pixel cell group of FIG. 3. As shown in FIG. 4A, the first pixel cell in the first pixel cell group Gr1, for example, the first pixel cell PXL1 in the column A of pixel cells shown in FIG. 3, includes a thin film transistor TFT, a pixel electrode PE, a common electrode (not shown), and a liquid crystal layer (not shown). The thin film transistor TFT outputs the data signal of the first data line DL1 in response to the first scan pulse SP1 from the first gate line GL1. The pixel electrode PE receives the data signal from the thin film transistor TFT. The common electrode (not shown) is placed opposite to the pixel electrode PE. The liquid crystal layer is positioned between the pixel electrode PE and the common electrode.

The thin film transistor TFT is formed at a crossing area of the first gate line GL1 and the first data line DL1. The thin film transistor TFT includes a gate electrode GE connected to the first gate line GL1, a semiconductor layer 401 overlapped with the gate electrode GE, a source electrode SE connected to the first data line, and a drain electrode DE connected to the pixel electrode PE.

In an embodiment, the second and third data lines DL2 and DL3 cross the first pixel cell PXL1, and are overlapped by the pixel electrode PE of the first pixel cell PXL1. Accordingly, the overlapped area between the pixel electrode PE and the second data line DL2, and the overlapped area between the pixel electrode PE and the third data line DL3 form a plurality of capacitors. The overlapped areas between the second data line DL2 and pixel electrode PE, and the overlapped areas between the third data lines DL3 and pixel electrode PE can be reduced to limit the effect of the capacitors on the data signal.

To reduce the overlapped area between the second and third data lines DL2 and DL3, respectively, and the pixel electrode PE, the pixel electrode PE includes three transparent electrodes TE1, TE2 and TE3, and two connection electrodes BE1 and BE2 for electrically connecting the transparent electrodes TE1, TE2 and TE3. The first transparent electrode TE1 is positioned between the first data line DL1 and the second data line DL2, the second transparent electrode TE2 is positioned between the second data line DL2 and the third data line DL3, and the third transparent electrode TE3 is positioned between the third data line DL3 and the first data line in the adjacent pixel cell (not shown). The drain electrode DE of the thin film transistor TFT can be connected to any one of the first transparent electrode TE1, the second transparent electrode TE2, the third transparent electrode TE3, the first connection electrode BE1, and the second connection electrode BE2. For example, the drain electrode DE of the thin film transistor TFT is connected to the first transparent electrode TE1.

The first connection electrode BE1 electrically connects the first transparent electrode TE1 to the second transparent electrode TE2. The second connection electrode BE2 electrically connects the second transparent electrode TE2 to the third transparent electrode TE3.

Accordingly, the first to third transparent electrodes TE1 to TE3 do not overlap the second and third data lines DL2 and DL3. However, the first connection electrode BE1 partially overlaps the second data line DL2, and the second connection electrode BE2 partially overlaps the third data line DL3. Accordingly, the overlapped area between the pixel electrode PE and the second and third data lines DL2 and DL3, respectively, is minimized.

The areas of the first and second connection electrodes BE1 and BE2 can be reduced to further reduce the overlap area. Each of the first and second connection electrodes BE1 and BE2 is given an appropriate size for electrically connecting the transparent electrodes TE1, TE2 and TE3.

The other pixel cells PXL within the first pixel cell group Gr1 are similar in structure to the first pixel cell PXL1. Specifically, the second and third pixel cells PXL2 and PXL3 are similar in structure to the first pixel cell PXL1.

Figure 4B:
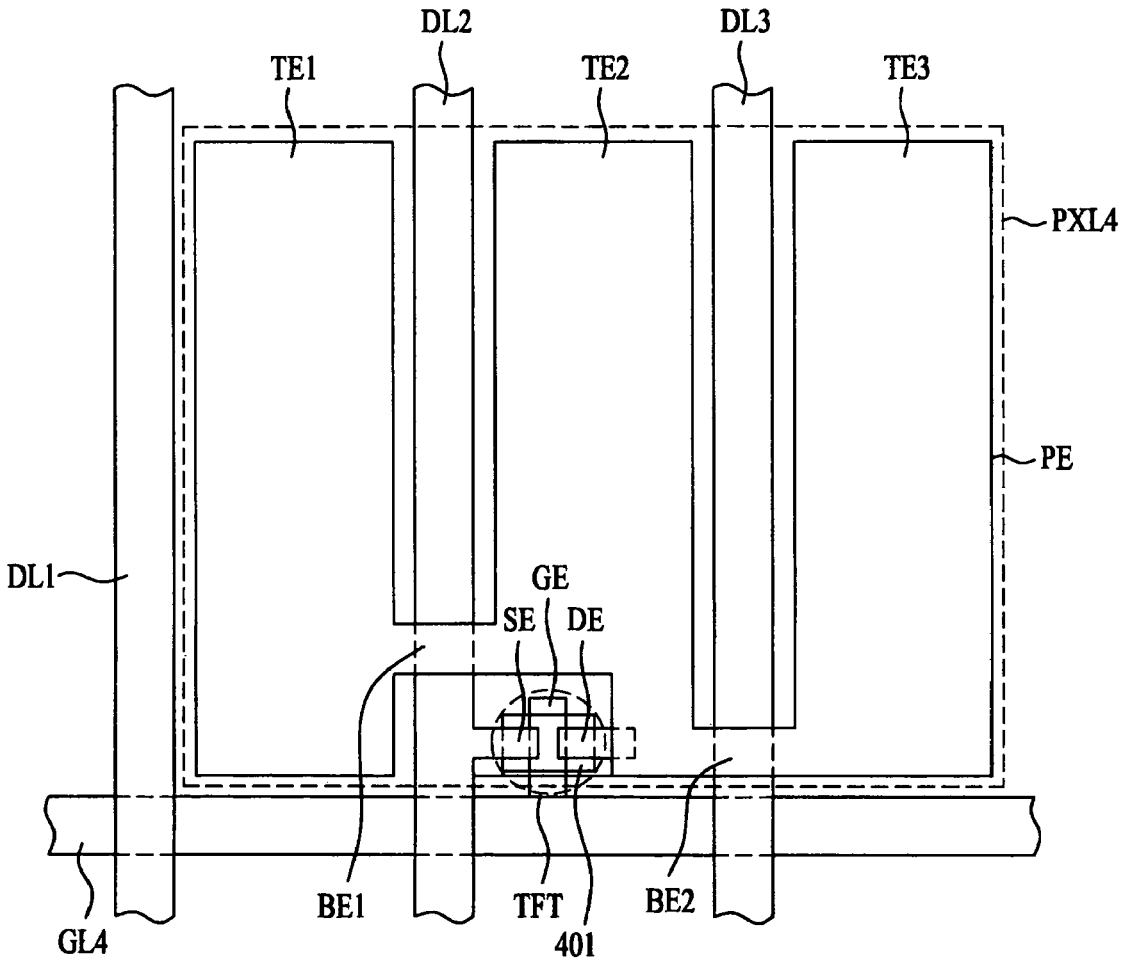
FIG. 4B shows an exemplary first pixel cell of the second pixel cell group of FIG. 3.

FIG. 4B shows an exemplary first pixel cell of the second pixel cell group of FIG. 3. As shown in FIG. 4B, the first pixel cell in the second pixel cell group Gr2, for example, the fourth pixel cell PXL4 in the column A of pixel cells shown in FIG. 3, includes a thin film transistor TFT, a pixel electrode PE, a common electrode (not shown), and a liquid crystal layer (not shown). The thin film transistor TFT outputs the data signal of the second data line DL2 in response to the fourth scan pulse SP4 from the fourth gate line GL4. The pixel electrode PE receives the data signal from the thin film transistor TFT. The common electrode (not shown) is positioned opposite to the pixel electrode PE. The liquid crystal layer is positioned between the pixel electrode PE and the common electrode.

The thin film transistor TFT is formed at a crossing area of the fourth gate line GL4 and the second data line DL2. The thin film transistor TFT includes a gate electrode GE connected to the fourth gate line GL4, a semiconductor layer 401 overlapped with the gate electrode GE, a source electrode SE connected to the second data line DL2, and a drain electrode DE connected to the pixel electrode PE.

In an embodiment, the pixel electrode PE of the fourth pixel cell PXL4 is similar in shape to the pixel electrode PE of the first pixel cell PXL1. In the fourth pixel cell PXL4, the drain electrode DE of the thin film transistor TFT can be connected to any one of the first transparent electrode TE1, the second transparent electrode TE2, the third transparent electrode TE3, the first connection electrode BE1, and the second connection electrode BE2. For example, as shown in FIG. 4B, the drain electrode DE of the thin film transistor TFT is connected to the second transparent electrode TE2. The other pixel cells PXL of the second pixel cell group Gr2 are similar in structure to the fourth pixel cell PXL4. Specifically, the fifth and sixth pixel cells PXL5 and PXL6 are similar in structure to the fourth pixel cell PXL4.

Figure 4C:
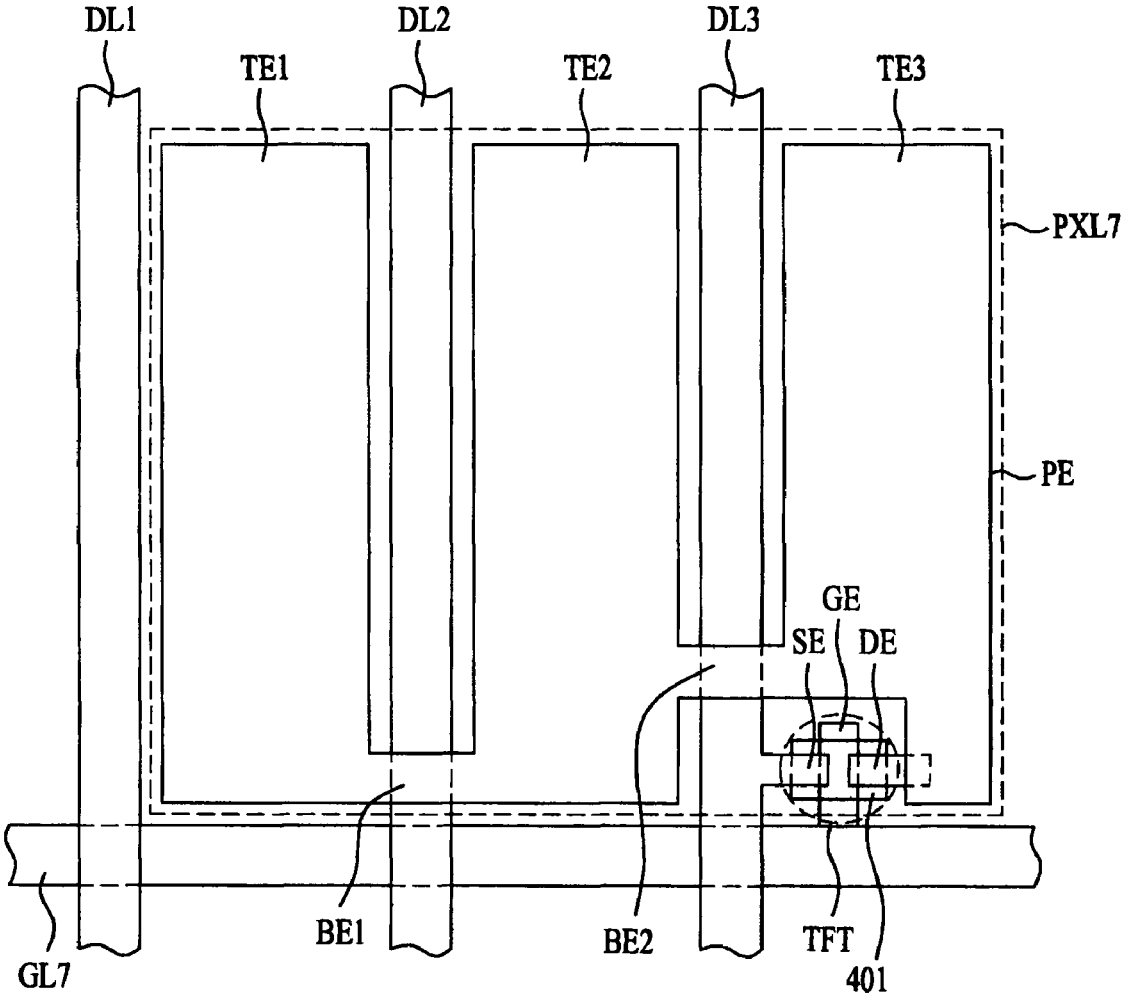
FIG. 4C shows an exemplary first pixel cell of the third pixel cell group of FIG. 3.

FIG. 4C shows an exemplary first pixel cell of the third pixel cell group of FIG. 3. As shown in FIG. 4C, the first pixel cell in the third pixel cell group Gr3, for example the seventh pixel cell PXL7 in the column A of pixel cells shown in FIG. 3, includes a thin film transistor TFT, a pixel electrode PE, a common electrode (not shown), and a liquid crystal layer (not shown). The thin film transistor TFT outputs the data signal of the third data line DL3 in response to the seventh scan pulse SP7 from the seventh gate line GL7. The pixel electrode PE receives the data signal from the thin film transistor TFT. The common electrode (not shown) is opposite to the pixel electrode PE. The liquid crystal layer is positioned between the pixel electrode PE and the common electrode.

The thin film transistor TFT of the seventh pixel cell PXL7 is formed at a crossing area of the seventh gate line GL7 and the third data line DL3. The thin film transistor TFT includes a gate electrode GE connected to the seventh gate line GL7, a semiconductor layer 401 overlapped with the gate electrode GE, a source electrode SE connected to the third data line DL3, and a drain electrode DE connected to the pixel electrode PE.

The pixel electrode PE of the seventh pixel cell PXL7 is similar in shape to the pixel electrode PE of the first pixel cell PXL1. In the seventh pixel cell PXL7, the drain electrode DE of the thin film transistor TFT may be connected to any one of the first transparent electrode TE1, the second transparent electrode TE2, the third transparent electrode TE3, the first connection electrode BE1, and the second connection electrode BE2. For example, as shown in FIG. 4C, the drain electrode DE of the thin film transistor is connected to the third transparent electrode TE3. The other pixel cells PXL of the third pixel cell group Gr3 are similar in structure to the pixel cell PXL7. That is, the eighth and ninth pixel cells PXL8 and PXL9 are similar in structure to the seventh pixel cell PXL7.

The pixel cells PXL7 to PXL9 of the third pixel cell group Gr3 are positioned farther from the data driver 202 than the pixel cells PXL4 to PXL6 of the second pixel group Gr2. That is, a distance from the pixel cells PXL7 to PXL9 of the third pixel cell group Gr3 to the data driver 202 is greater than a distance from the pixel cells PXL4 to PXL6 of the second pixel group Gr2 to the data driver 202. Also, the pixel cells PXL4 to PXL6 of the second pixel cell group Gr2 are positioned farther from the data driver 202 than the pixel cells PXL1 to PXL3 of the first pixel cell group Gr1. That is, a distance from the pixel cells PXL4 to PXL6 of the second pixel cell group Gr2 to the data driver 202 is greater than a distance from the pixel cells PXL1 to PXL3 of the first pixel group Gr1 to the data driver 202. Accordingly, the pixel cells PXL1 to PXL3 of the first pixel cell group Gr1 are positioned nearest to the data driver 202.

As a result, the data signal supplied to the pixel cells PXL7 to PXL9 of the third pixel cell group Gr3 can be more distorted than the data signal supplied to the pixel cells PXL4 to PXL6 of the second pixel group Gr2, and the data signal supplied to the pixel cells PXL4 to PXL6 of the second pixel group Gr2 can be more distorted than the data signal supplied to the pixel cells PXL1 to PXL3 of the first pixel cell group Gr1.

To decrease the deviation of distortion in the pixel cell groups Gr1 to Gr3, among the first to third data lines DL1 to DL3 respectively connected with the first to third pixel cell groups Gr1 to Gr3, the first data line DL1 has the smallest width, the second data line DL2 has the intermediate width, and the third data line DL3 has the largest width.

Figure 5A:
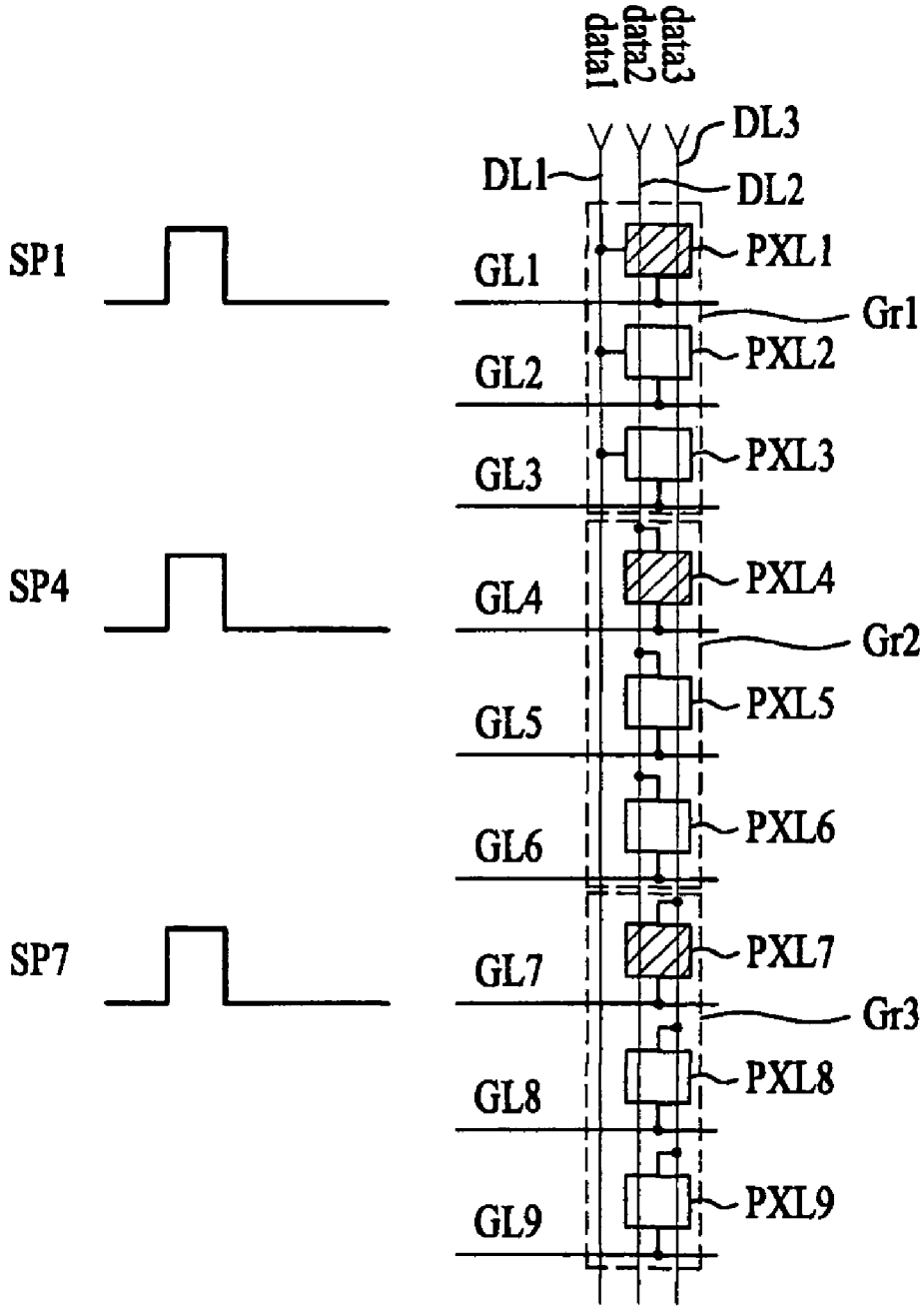
FIG. 5A illustrates an operation of a column of pixel cells during a first scan period in accordance with the scanning pattern shown in FIG. 3.

FIG. 5A illustrates an operation of a column of pixel cells during a first scan period in accordance with the scanning pattern shown in FIG. 3. Referring to FIG. 5A, the gate driver 201 concurrently outputs the first, fourth and seventh scan pulses SP1, SP4 and SP7 during a first scan period. Accordingly, the first scan pulse SP1 is supplied to the first gate line GL1, the fourth scan pulse SP4 is supplied to the fourth gate line GL4, and the seventh scan pulse is supplied to the seventh gate line GL7. Thus, the first, fourth and seventh gate lines GL1, GL4 and GL7 are concurrently driven. Hence, the first pixel cell PXL1 connected to the first gate line GL1, the fourth pixel cell PXL4 connected to the fourth gate line GL4, and the seventh pixel cell PXL7 connected to the seventh gate line GL7 are concurrently driven. That is, the respective thin film transistors of the first, fourth and seventh pixel cells PXL1, PXL4 and PXL7 are turned-on at the same time.

The data driver 202 concurrently outputs the first to third data signals data 1, data2, and data3. Accordingly, the first data signal data1 is supplied to the first data line DL1, the second data signal data2 is supplied to the second data line DL2, and the third data signal data3 is supplied to the third data line DL3. Then, the first data signal data1 charged in the first data line DL1 is supplied to the first pixel cell PXL1, which is connected to the first data line DL1, and the thin film transistor TFT of which is turned-on. Thus, the first data signal data1 is supplied to the pixel electrode PE of the first pixel cell PXL1 through the turned-on thin film transistor TFT of the first pixel cell PXL1. Accordingly, the first pixel cell PXL1 displays images in accordance with the first data signal data1.

The second data signal data2 charged in the second data line DL2 is supplied to the fourth pixel cell PXL4, which is connected to the second data line DL2, and the thin film transistor TFT of which is turned-on. That is, the second data signal data2 is supplied to the pixel electrode PE of the fourth pixel cell PXL4 through the turned-on thin film transistor TFT of the fourth pixel cell PXL4. Accordingly, the fourth pixel cell PXL4 displays images in accordance with the second data signal data2.

The third data signal data3 charged in the third data line DL3 is supplied to the seventh pixel cell PXL7, which is connected to the third data line DL3, and the thin film transistor TFT of which is turned-on. Thus, the third data signal data3 is supplied to the pixel electrode PE of the seventh pixel cell PXL7 through the turned-on thin film transistor TFT of the seventh pixel cell PXL7. Accordingly, the seventh pixel cell PXL7 displays images in accordance with the third data signal data3.

Figure 5B:
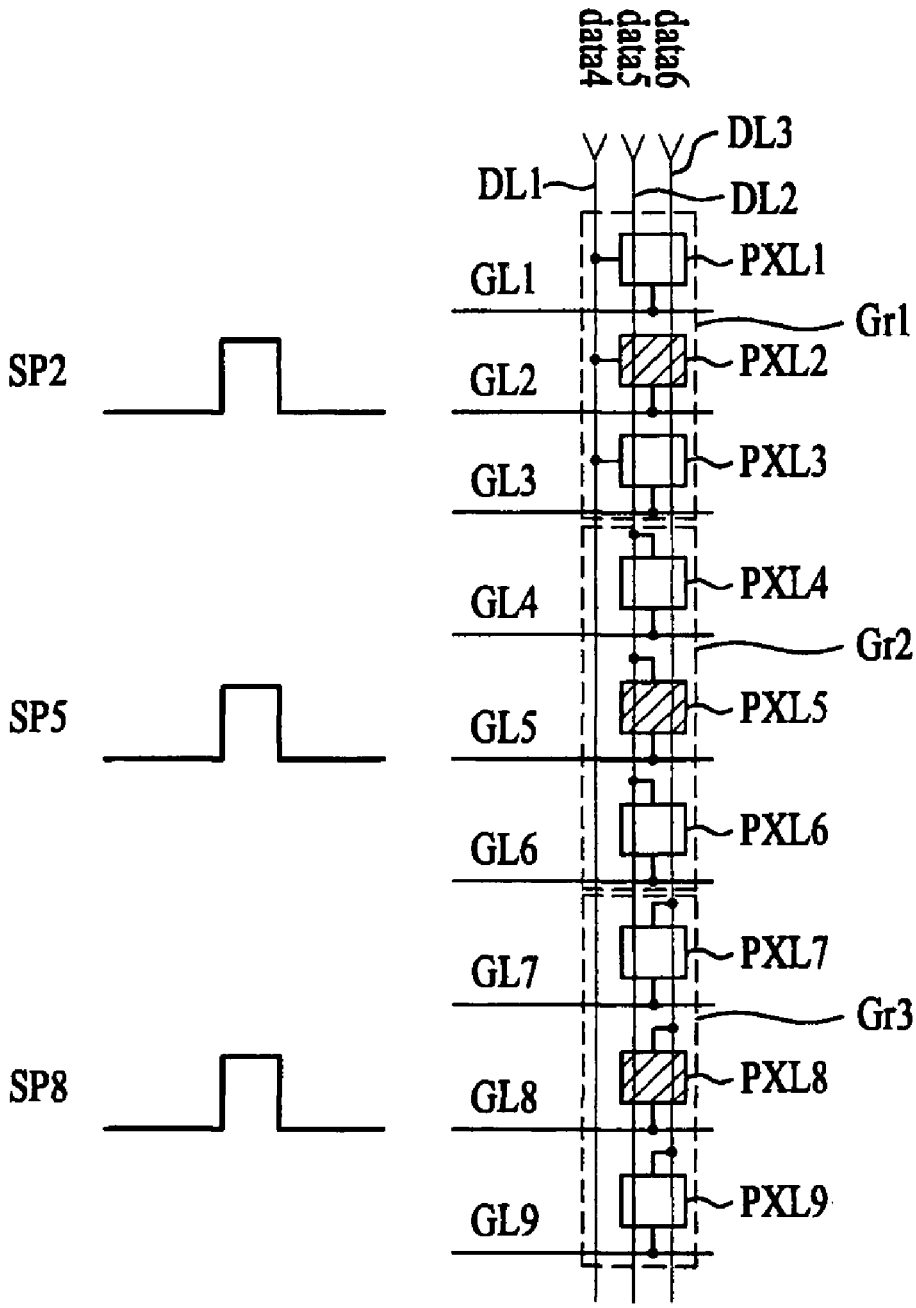
FIG. 5B illustrates an operation of a column of pixel cells during a second scan period in accordance with the scanning pattern shown in FIG. 3.

FIG. 5B illustrates an operation of a column of pixel cells during a second scan period in accordance with the scanning pattern shown in FIG. 3. As shown in FIG. 5B, the gate driver 201 concurrently outputs the second, fifth and eighth scan pulses SP2, SP5 and SP8 at a second scan period. Accordingly, the second scan pulse SP2 is supplied to the second gate line GL2, the fifth scan pulse SP5 is supplied to the fifth gate line GL5, and the eighth scan pulse SP8 is supplied to the eighth gate line GL8. Accordingly, the second, fifth and eighth gate lines GL2, GL5 and GL8 are concurrently driven.

The second pixel cell PXL2 connected to the second gate line GL2, the fifth pixel cell PXL5 connected to the fifth gate line GL5, and the eighth pixel cell PXL8 connected to the eighth gate line GL8 are concurrently driven. Thus, the respective thin film transistors of the second, fifth and eighth pixel cells PXL2, PXL5 and PXL8 are turned-on at the same time.

The data driver 202 concurrently outputs the fourth to sixth data signals data4 to data6. Accordingly, the fourth data signal data4 is supplied to the first data line DL1, the fifth data signal data5 is supplied to the second data line DL2, and the sixth data signal data6 is supplied to the third data line DL3. Then, the fourth data signal data4 charged in the first data line DL1 is supplied to the second pixel cell PXL2, which is connected to the first data line DL1, and the thin film transistor TFT of which is turned-on. Thus, the fourth data signal data4 is supplied to the pixel electrode PE of the second pixel cell PXL2 through the turned-on thin film transistor TFT of the second pixel cell PXL2. Accordingly, the second pixel cell PXL2 displays images in accordance with the fourth data signal data4.

The fifth data signal data5 charged in the second data line DL2 is supplied to the fifth pixel cell PXL5, which is connected to the second data line DL2, the thin film transistor TFT of which is turned-on. Thus, the fifth data signal data5 is supplied to the pixel electrode PE of the fifth pixel cell PXL5 through the turned-on thin film transistor TFT. Accordingly, the fifth pixel cell PXL5 displays images in accordance with the fifth data signal data5.

The sixth data signal data6 charged in the third data line DL3 is supplied to the eighth pixel cell PXL8, which is connected to the third data line DL3, the thin film transistor TFT of which is turned-on. Thus, the sixth data signal data6 is supplied to the pixel electrode PE of the eighth pixel cell PXL8 through the turned-on thin film transistor TFT. Accordingly, the eighth pixel cell PXL8 displays images in accordance with the sixth data signal data6.

Figure 5C:
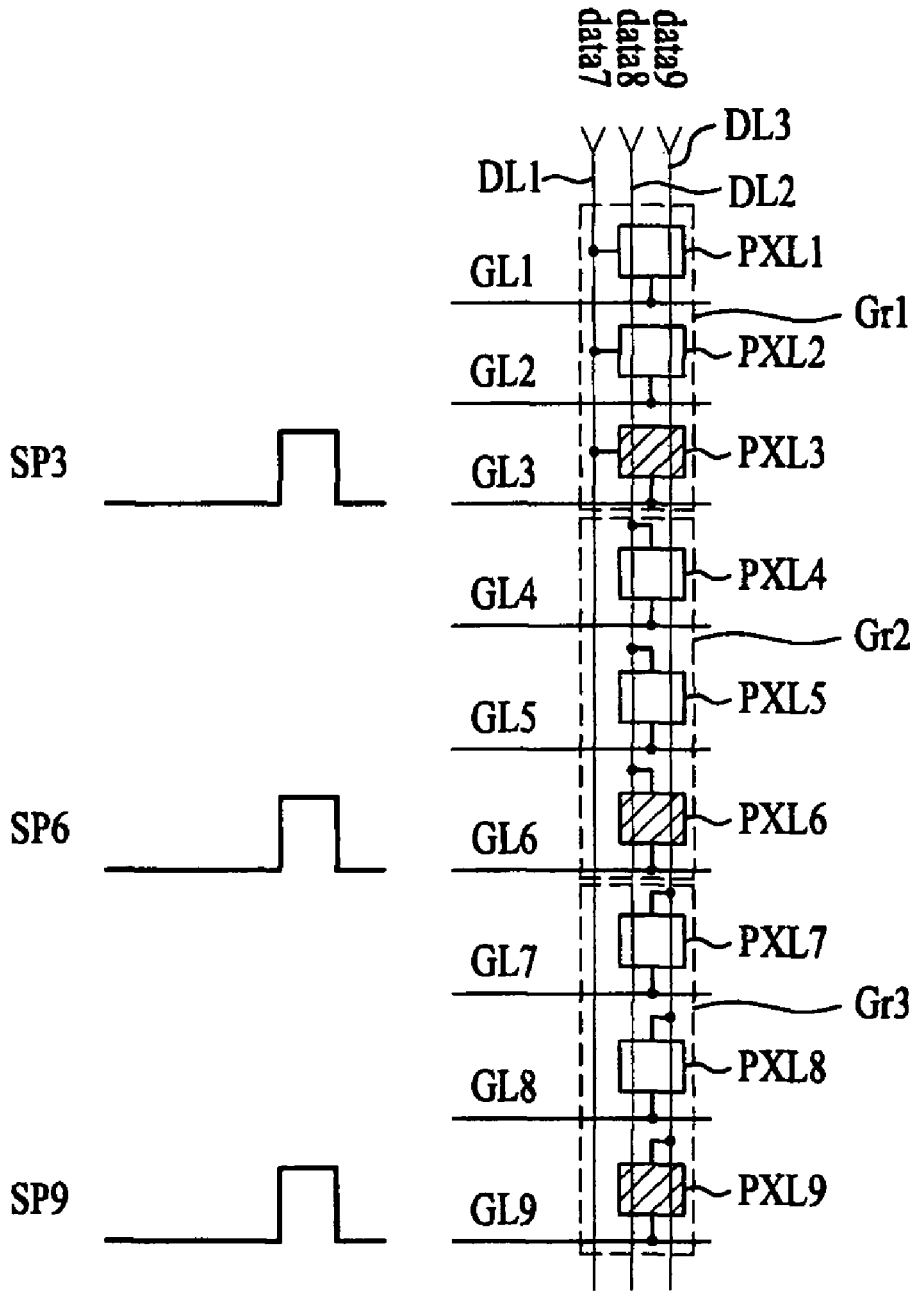
FIG. 5C illustrates an operation of a column of pixel cells during a third scan period in accordance with the scanning pattern shown in FIG. 3.

FIG. 5C illustrates an operation of a column of pixel cells during a third scan period in accordance with the scanning pattern shown in FIG. 3. As shown in FIG. 5C, the gate driver 201 concurrently outputs the third, sixth and ninth scan pulses SP3, SP6 and SP9 during a third scan period. Accordingly, the third scan pulse SP3 is supplied to the third gate line GL3, the sixth scan pulse SP6 is supplied to the sixth gate line GL6, and the ninth scan pulse SP9 is supplied to the ninth gate line GL9. Accordingly, the third, sixth and ninth gate lines GL3, GL6 and GL9 are concurrently driven.

The third pixel cell PXL3 connected to the third gate line GL3, the sixth pixel cell PXL6 connected to the sixth gate line GL6, and the ninth pixel cell PXL9 connected to the ninth gate line GL9 are concurrently driven. Thus, the respective thin film transistors TFT of the third, sixth and ninth pixel cells PXL3, PXL6 and PXL9 are turned-on at the same time.

The data driver 202 outputs the seventh to ninth data signals data7 to data9 at the same time. Accordingly, the seventh data signal data7 is supplied to the first data line DL1, the eighth data signal data8 is supplied to the second data line DL2, and the ninth data signal data9 is supplied to the third data line DL3.

Then, the seventh data signal data7 charged in the first data line DL1 is supplied to the third pixel cell PXL3, which is connected to the first data line DL1, and the thin film transistor TFT of which is turned-on. Thus, the seventh data signal data7 is supplied to the pixel electrode PE of the third pixel cell PXL3 through the turned-on thin film transistor TFT of the third pixel cell PXL3. Accordingly, the third pixel cell PXL3 displays images in accordance with the seventh data signal data7.

The eighth data signal data8 charged in the second data line DL2 is supplied to the sixth pixel cell PXL6, which is connected to the second data line DL2, and the thin film transistor TFT of which is turned-on. Thus, the eighth data signal data8 is supplied to the pixel electrode PE of the sixth pixel cell PXL6 through the turned-on thin film transistor TFT. Accordingly, the sixth pixel cell PXL6 displays images in accordance the eighth data signal data8.

The ninth data signal data9 charged in the third data line DL3 is supplied to the ninth pixel cell PXL9, which is connected to the third data line DL3, and the thin film transistor TFT of which is turned-on. Thus, the ninth data signal data9 is supplied to the pixel electrode PE of the ninth pixel cell PXL9 through the turned-on thin film transistor TFT. Accordingly, the ninth pixel cell PXL9 displays images in accordance with the ninth data signal data9.

In an embodiment, the first to ninth data signals data1 to data9 are R data signals for displaying the red color. Accordingly, the first sub frame is completed at the end of the third scan period. During the first sub frame, the backlight unit 204 emits red light.

The one frame period can be completed by processing of the second and third sub frames in a similar manner. For example, G data signals for displaying green color are supplied to the first to third data lines DL1 to DL3 during the second sub frame. Accordingly, the backlight unit 204 emits green light during the second sub frame when G data signals are received. Similarly, B data signals for displaying blue color are supplied to the first to third data lines DL1 to DL3 during the third sub frame. Accordingly, the backlight unit 204 emits blue light during the third sub frame when B data signals are received.

In accordance with embodiments of the present invention, the gate lines GL1 to GL9 are divided into the pixel cell groups Gr1 to Gr3. Then, the gate lines in each pixel cell group are concurrently driven. Accordingly, it is possible to increase the scan time for each gate line GL.

The scan time for each gate line GL increases as the number of pixel cell groups increases. Specifically, if the number of concurrently driven gate lines increases, the scan time for each gate line increases accordingly. For example, in the case of the related art display device, each gate line (GL1 to GL9) is scanned for one horizontal time period to drive nine gate lines GL during one sub frame, each sub frame corresponding to nine horizontal time periods. In contrast, in a display device according to embodiments of the present invention, each gate line is scanned for three horizontal time periods to drive the nine gate lines GL1 to GL9 during one sub frame. Thus, the scan time for each gate line increases by a factor of three in the display device that conforms to embodiments of the present invention compared to the related art display device.

Accordingly, the scan time for each gate line in the display device according to embodiments of the present invention is three times as long as the related art. Eventually, the turn-on time of the thin film transistor TFT provided in each pixel cell PXL of the display device according to embodiments of the present invention is three times as long as the related art. In this respect, even though the size of the thin film transistor TFT is not large, sufficient charge time is provided for each pixel cell PXL.

Figure 6:
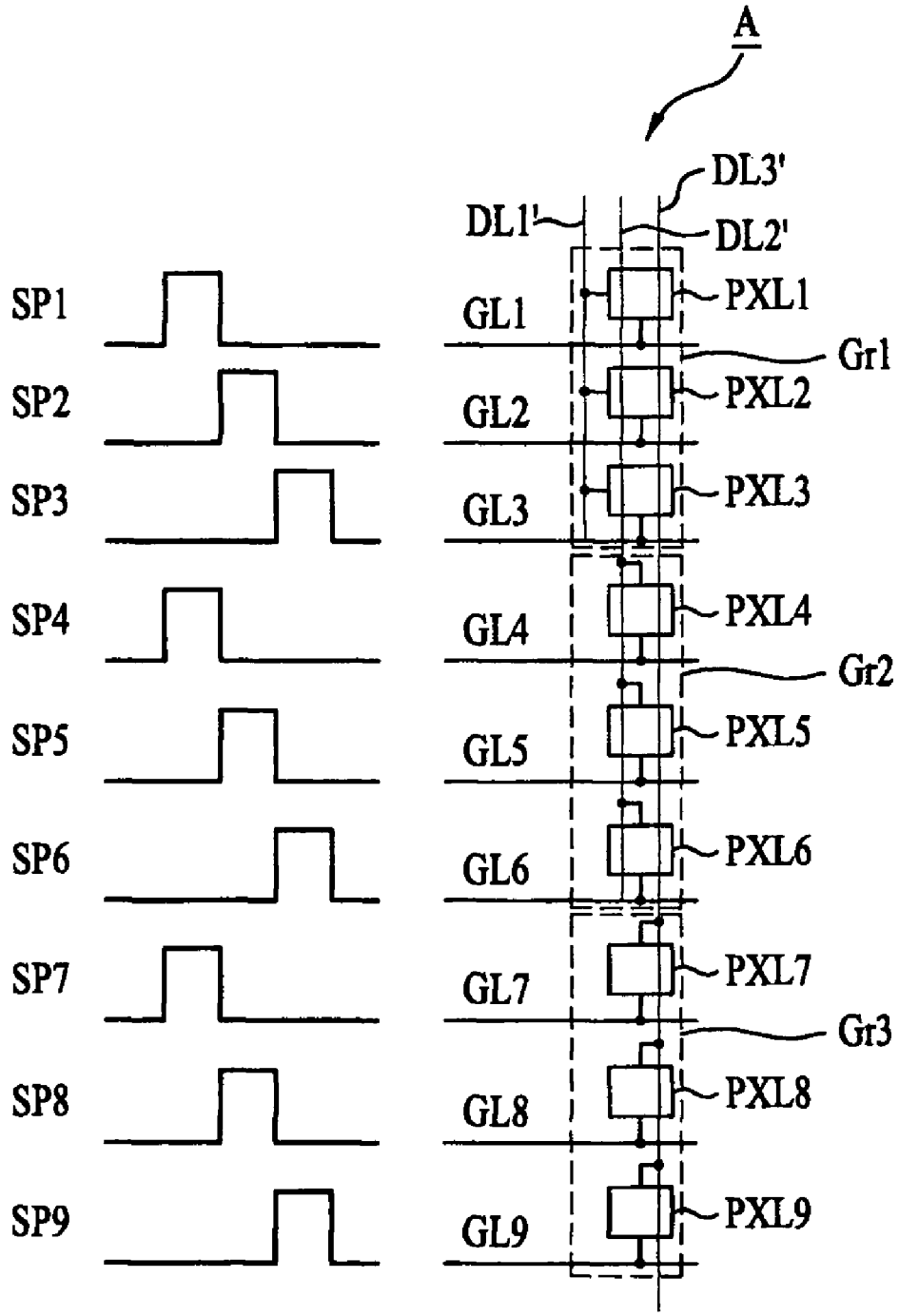
FIG. 6 illustrates an exemplary structure for a column pixel cells from the LCD device of FIG. 2 according to another embodiment of the present invention.

FIG. 6 illustrates an exemplary structure for a column of pixel cells from the LCD device of FIG. 2 according to another embodiment of the present invention. As shown in FIG. 6, first to third data lines DL1' to DL3' have different lengths. That is, the length of the n-th data line, where 'n' is a natural number greater than 2, is such that the n-th data line overlaps the pixel cells from the first to n-th pixel cell groups Gr1 to Gm. For example, the first data line DL1' does not overlap any of pixel cells PXL1 to PXL9. The second data line DL2' extends from the data driver 202 to the third pixel cell of the second pixel cell group Gr2, which is pixel cell PXL6. Thus, the second data line DL2' overlaps the pixel cells PXL1 to PXL3 of the first pixel cell group Gr1 and the pixel cells PXL4 to PXL6 of the second pixel cell group Gr2. Moreover, the first data line DL1' is shorter than the second data line DL2' and the third data line DL3'. Also, the third data line DL3' extends from the data driver 204 to the third pixel cell in the third pixel cell group Gr3, which is pixel cell PXL9. Thus, the third data line DL3' overlaps the pixel cells PXL1 to PXL9 from the first to third pixel cell groups Gr1 to Gr3. Accordingly, the aperture ratio of the pixel cells PXL4 to PXL9 from pixel cell groups Gr2 and Gr3 is higher than the aperture ratio of the pixel cells PXL1 to PXL9 shown in FIG. 3.

Still referring to FIG. 6, the data lines DL1', DL2' and DL3' have different lengths from each other. Accordingly, the electrical characteristics, such as the RC characteristics of the data lines, differ among the data lines DL1', DL2' and DL3'. To compensate for the difference in lengths between DL1' and DL2', the data line DL2' can be made correspondingly larger or wider than the data line DL1'. Similarly, to compensate for the difference in lengths between DL2' and DL3', the data line DL3' can be made correspondingly larger or wider than the data line DL2'. Accordingly, the difference in electrical characteristics, such as the RC-characteristics, can be compensated by making longer data lines correspondingly wider than shorter data lines to obtain substantially the same RC-characteristics for the data lines DL1', DL2' and DL3'.

Referring back to FIG. 4A, the pixel electrode PE provided in each of the pixel cells PXL1 to PXL3 of the first pixel cell group Gr1 includes three transparent electrodes TE1, TE2 and TE3 and two connection electrodes BE1 and BE2. Similarly, referring back to FIG. 4B, the pixel electrode PE provided in each of the pixel cells PXL4 to PXL6 of the second pixel cell group Gr2 includes three transparent electrodes TE1, TE2 and TE3 and two connection electrodes BE1 and BE2. Furthermore, referring back to FIG. 4C, the pixel electrode PE provided in each of the pixel cells PXL7 to PXL9 of the third pixel cell group Gr3 includes two transparent electrodes and one connection electrode.

In embodiments of the present invention, a plurality of gate lines are driven at a same time, thereby obtaining allowing sufficient charge time for each pixel cell PXL.

Figure 7:
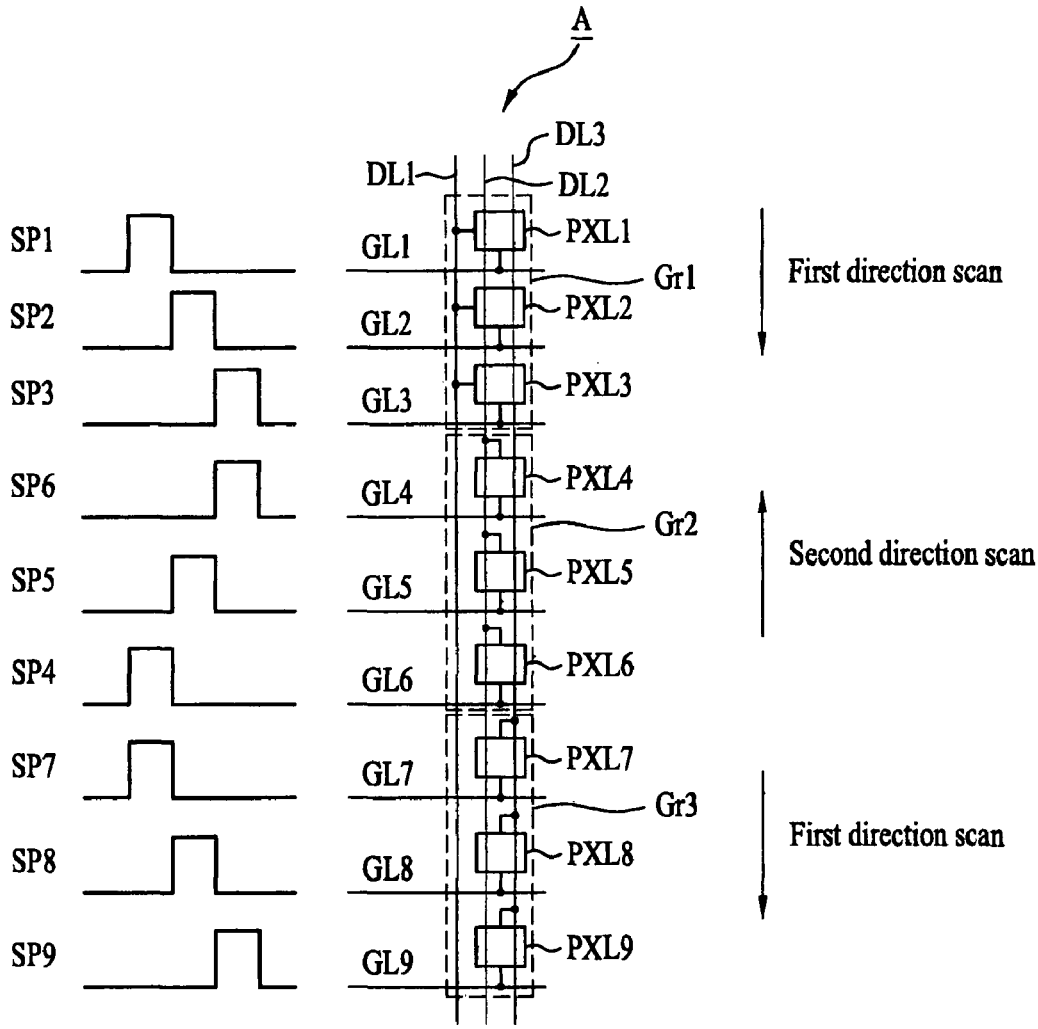
FIG. 7 shows a second exemplary scanning pattern along a column A pixel cells from the LCD device of FIG. 2.

FIG. 7 shows a second exemplary scanning pattern along a column A pixel cells from the LCD device of FIG. 2. In an embodiment of the present invention, the respective columns A of pixel cells have the same structure. For explanatory purposes, the exemplary column A of pixel cells is shown with nine pixel cells PXL divided into first to third pixel cell groups Gr1 to Gr3. Thus, each pixel cell group has three pixel cells PXL. The first pixel cell group Gr1 includes the first to third pixel cells PXL1 to PXL 3, the second pixel cell group Gr2 includes the fourth to sixth pixel cells PXL4 to PXL 6, and the third pixel cell group Gr3 includes the seventh to ninth pixel cells PXL7 to PXL9. The first to ninth gate lines GL1 to GL9 are respectively connected to the first to ninth pixel cells PXL1 to PXL9. The column A of pixel cells PXL1 to PXL9 is electrically connected to three data lines DL1 to DL3. Thus, the number of pixel cell groups provided in one column A of pixel cells is equal to the number of data lines connected to the column A of the pixel cells PXL1 to PXL9.

In an embodiment of the present invention, the pixel cells PXL within one of the respective pixel cell groups Gr1 to Gr3 are electrically connected to the same data line. For example, the first data line DL1 is electrically connected to the first pixel cell PXL1, the second pixel cell PXL2, and the third pixel cell PXL3. The second data line DL2 is electrically connected to the fourth pixel cell PXL4, the fifth pixel cell PXL5, and the sixth pixel cell PXL6. The third data line DL3 is electrically connected to the seventh pixel cell PXL7, the eighth pixel cell PXL8, and the ninth pixel cell PXL9.

The gate lines GL1 to GL9 electrically connected to the pixel cells PXL in the respective pixel cell groups Gr1 to Gr3 are sequentially driven. In an embodiment, the first gate line in the (2n−1)-th pixel cell group ('n' is a natural number), and the last gate line in the (2n)-th pixel cell group are concurrently driven. Thus, the first gate line in a pixel cell group and the last gate line in the next pixel cell group are concurrently driven.

As shown in FIG. 7, the first to third gate lines GL1 to GL3 in the first pixel cell group Gr1 are sequentially driven according to the order of the pixel cells in the first pixel cell group Gr1. In contrast, the fourth to sixth gate lines GL4 to GL6 in the second pixel cell group Gr2 are driven in a reverse order, the gate line GL6 being driven first, and the gate line GL4 being driven last. Thus, the gate lines in the (2n−1)-th pixel cell group are sequentially driven from the first to the last. In contrast, the gate lines in the (2n)-th pixel cell group are sequentially driven in reverse order from the last to the first.

Thus, as shown in FIG. 7, the first to third gate lines GL1 to GL3 connected to the first to third pixel cells PXL1 to PXL3 in the first pixel cell group Gr1 are sequentially driven in a first scan direction by first to third scan pulses SP1 to SP3, respectively. For example, the first gate line GL1 is driven first by the first scan pulse SP1, the second gate line GL2 is driven second by the second scan pulse SP2, and the third gate line GL3 is driven third by the third scan pulse SP3. Accordingly, the first to third pixel cells PXL1 to PXL3 are sequentially driven at the first scan direction.

In the second pixel cell group Gr2, the fourth to sixth gate lines GL4 to GL6 connected to the fourth to sixth pixel cells PXL4 to PXL 6 are sequentially driven in a second scan direction by the fourth to sixth scan pulses SP4 to SP6. The fourth to sixth pixel cells PXL4 to PXL6 are sequentially driven. The gate lines GL4 to GL6 are sequentially driven from the last gate line GL6 to the first gate line GL4 within the second pixel cell group Gr2. For example, the sixth gate line GL6 is driven first by the fourth scan pulse SP4, the fifth gate line GL5 is driven second by the fifth scan pulse SP5, and the fourth gate line GL4 is driven third by the sixth scan pulse SP6. Accordingly, the fourth to sixth pixel cells PXL4 to PXL6 are sequentially driven in a second direction which is opposite to the first direction.

In the third pixel cell group Gr3, the gate lines GL7 to GL9 are sequentially driven from the first gate line GL7 to the last gate line GL9 within the pixel cell group Gr3. In detail, the seventh gate line GL7 is driven first by the seventh scan pulse SP7, the eighth gate line GL8 is driven second by the eighth scan pulse SP8, and the ninth gate line GL9 is driven third by the ninth scan pulse SP9. Accordingly, the seventh to ninth pixel cells PXL7 to PXL9 are sequentially driven in the first direction.

In an embodiment, the first gate line GL1 connected to the first pixel cell PXL1, the sixth gate line GL6 connected to the sixth pixel cell PXL6, and the seventh gate line GL7 connected to the seventh pixel cell PXL7 are concurrently driven by the scan pulses SP1, SP4 and SP7. Also, the second gate line GL2 connected to the second pixel cell PXL2, the fifth gate line GL5 connected to the fifth pixel cell PXL5, and the eighth gate line GL8 connected to the eighth pixel cell PXL8 are concurrently driven by the scan pulses SP2, SP5 and SP8. Then, the third gate line GL3 connected to the third pixel cell PXL3, the fourth gate line GL4 connected to the fourth pixel cell PXL4, and the ninth gate line GL9 connected to the ninth pixel cell PXL9 are concurrently driven by the scan pulses SP3, SP6 and SP9.

The first scan pulse SP1 supplied to the first gate line GL1, the fourth scan pulse SP4 supplied to the sixth gate line GL6, and the seventh scan pulse SP7 supplied to the seventh gate line GL7 are outputted at the same time. The second scan pulse SP2 supplied to the second gate line GL2, the fifth scan pulse SP5 supplied to the fifth gate line GL5, and the eighth scan pulse SP8 supplied to the eighth gate line GL8 are outputted at the same time. The third scan pulse SP3 supplied to the third gate line GL3, the sixth scan pulse SP6 supplied to the fourth gate line GL4, and the ninth scan pulse SP9 supplied to the ninth gate line GL9 are outputted at the same time.

In an embodiment, the pixel cells shown in FIG. 7 have a similar structure to that of the pixel cells shown in FIG. 4A to FIG. 4C.

Figure 8A:
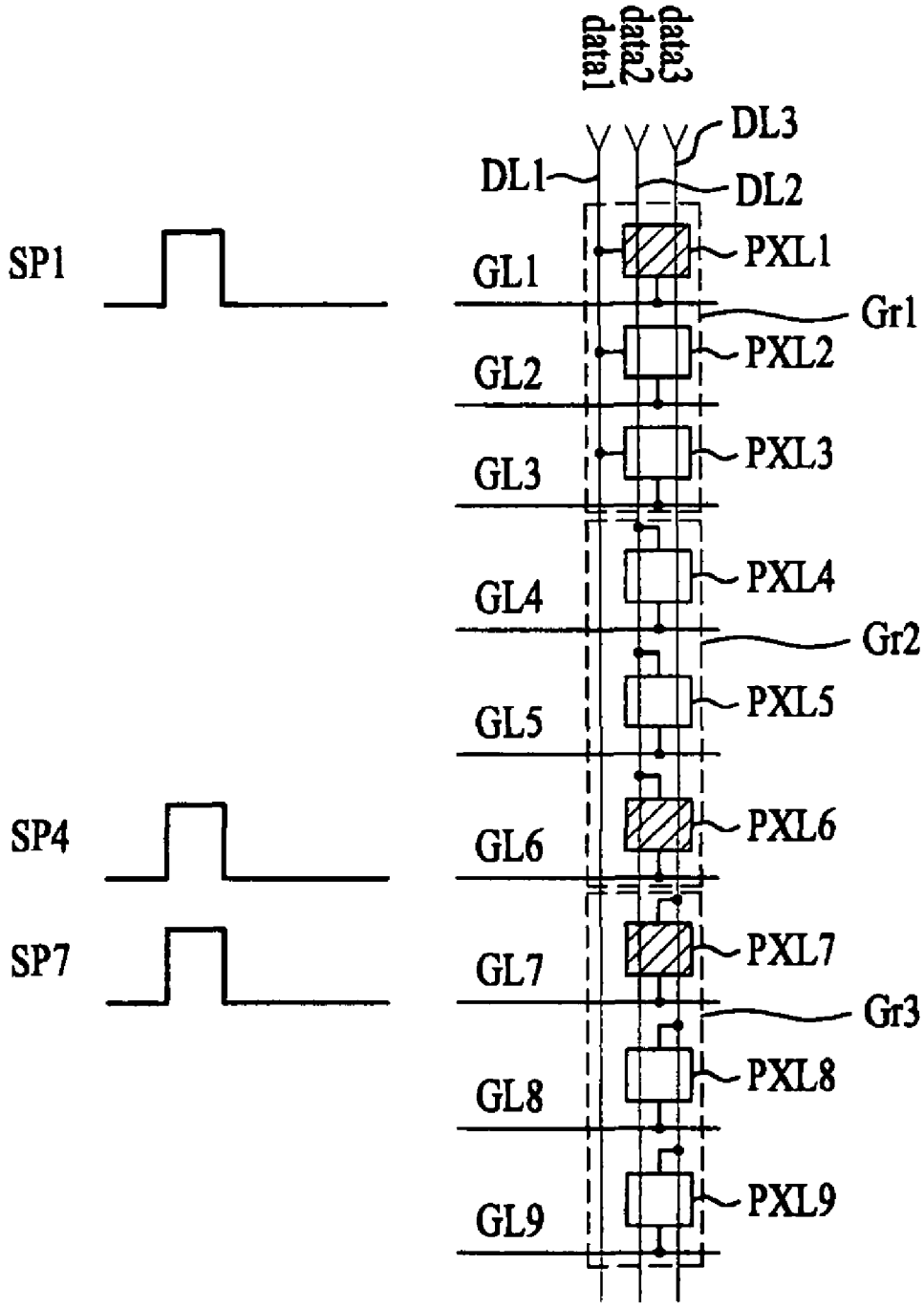
FIG. 8A illustrates an operation of a column of pixel cells during a first scan period in accordance with the scanning pattern shown in FIG. 7.

FIG. 8A illustrates an operation of a column of pixel cells during a first scan period in accordance with the scanning pattern shown in FIG. 7. Referring to FIG. 8A, the gate driver 201 concurrently outputs the first, fourth and seventh scan pulses SP1, SP4 and SP7 during a first scan period. Accordingly, the first scan pulse SP1 is supplied to the first gate line GL1, the fourth scan pulse SP4 is supplied to the sixth gate line GL6, and the seventh scan pulse is supplied to the seventh gate line GL7. Thus, the first, sixth and seventh gate lines GL1, GL6 and GL7 are concurrently driven. Hence, the first pixel cell PXL1 connected to the first gate line GL1, the sixth pixel cell PXL6 connected to the sixth gate line GL6, and the seventh pixel cell PXL7 connected to the seventh gate line GL7 are concurrently driven. That is, the respective thin film transistors of the first, sixth and seventh pixel cells PXL1, PXL6 and PXL7 are turned-on at the same time.

The data driver 202 concurrently outputs the first to third data signals. Accordingly, the first data signal data1 is supplied to the first data line DL1, the second data signal data2 is supplied to the second data line DL2, and the third data signal data3 is supplied to the third data line DL3. Then, the first data signal data1 charged in the first data line DL1 is supplied to the first pixel cell PXL1, which is connected to the first data line DL1, and the thin film transistor TFT of which is turned-on. Thus, the first data signal data1 is supplied to the pixel electrode PE of the first pixel cell PXL1 through the turned-on thin film transistor TFT of the first pixel cell PXL1. Accordingly, the first pixel cell PXL1 displays images in accordance with the first data signal data1.

The second data signal data2 charged in the second data line DL2 is supplied to the sixth pixel cell PXL6, which is connected to the second data line DL2, and the thin film transistor TFT of which is turned-on. That is, the second data signal data2 is supplied to the pixel electrode PE of the sixth pixel cell PXL6 through the turned-on thin film transistor TFT of the sixth pixel cell PXL6. Accordingly, the sixth pixel cell PXL6 displays images in accordance with the second data signal data2.

The third data signal data3 charged in the third data line DL3 is supplied to the seventh pixel cell PXL7, which is connected to the third data line DL3, and the thin film transistor TFT of which is turned-on. Thus, the third data signal data3 is supplied to the pixel electrode PE of the seventh pixel cell PXL7 through the turned-on thin film transistor TFT of the seventh pixel cell PXL7. Accordingly, the seventh pixel cell PXL7 displays images in accordance with the third data signal data3.

Figure 8B:
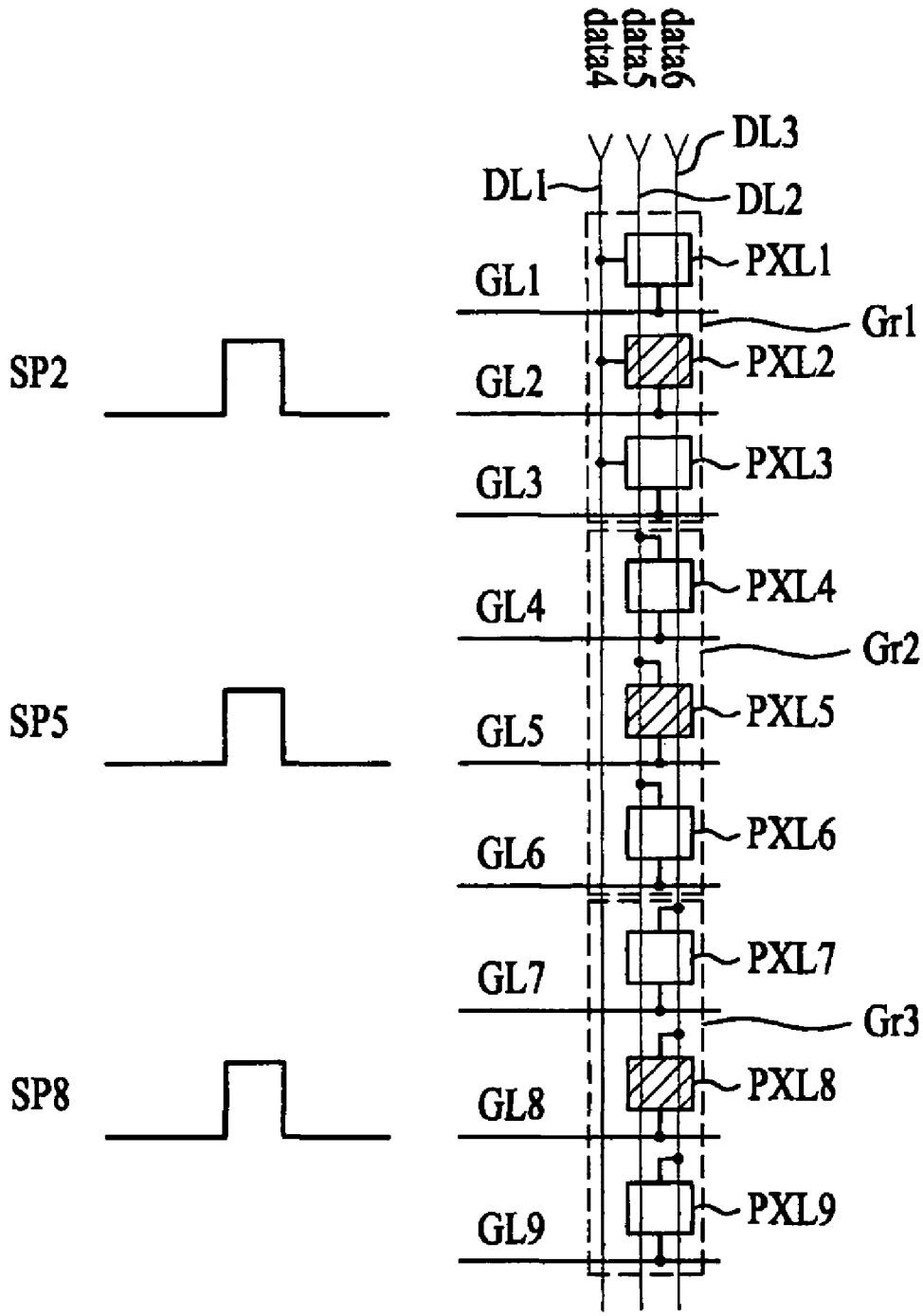
FIG. 8B illustrates an operation of a column of pixel cells during a second scan period in accordance with the scanning pattern shown in FIG. 7.

FIG. 8B illustrates an operation of a column of pixel cells during a second scan period in accordance with the scanning pattern shown in FIG. 7. As shown in FIG. 8B, the gate driver 201 concurrently outputs the second, fifth and eighth scan pulses SP2, SP5 and SP8 at a second scan period. Accordingly, the second scan pulse SP2 is supplied to the second gate line GL2, the fifth scan pulse SP5 is supplied to the fifth gate line GL5, and the eighth scan pulse SP8 is supplied to the eighth gate line GL8. Accordingly, the second, fifth and eighth gate lines GL2, GL5 and GL8 are concurrently driven.

The second pixel cell PXL2 connected to the second gate line GL2, the fifth pixel cell PXL5 connected to the fifth gate line GL5, and the eighth pixel cell PXL8 connected to the eighth gate line GL8 are concurrently driven. Thus, the respective thin film transistors of the second, fifth and eighth pixel cells PXL2, PXL5 and PXL8 are turned-on at the same time.

The data driver 202 concurrently outputs the fourth to sixth data signals data4 to data6. Accordingly, the fourth data signal data4 is supplied to the first data line DL1, the fifth data signal data5 is supplied to the second data line DL2, and the sixth data signal data6 is supplied to the third data line DL3. Then, the fourth data signal data4 charged in the first data line DL1 is supplied to the second pixel cell PXL2, which is connected to the first data line DL1, and the thin film transistor TFT of which is turned-on. Thus, the fourth data signal data4 is supplied to the pixel electrode PE of the second pixel cell PXL2 through the turned-on thin film transistor TFT of the second pixel cell PXL2. Accordingly, the second pixel cell PXL2 displays images in accordance with the fourth data signal data4.

The fifth data signal data5 charged in the second data line DL2 is supplied to the fifth pixel cell PXL5, which is connected to the second data line DL2, the thin film transistor TFT of which is turned-on. Thus, the fifth data signal data5 is supplied to the pixel electrode PE of the fifth pixel cell PXL5 through the turned-on thin film transistor TFT. Accordingly, the fifth pixel cell PXL5 displays images in accordance with the fifth data signal data5.

The sixth data signal data6 charged in the third data line DL3 is supplied to the eighth pixel cell PXL8, which is connected to the third data line DL3, the thin film transistor TFT of which is turned-on. Thus, the sixth data signal data6 is supplied to the pixel electrode PE of the eighth pixel cell PXL8 through the turned-on thin film transistor TFT. Accordingly, the eighth pixel cell PXL8 displays images in accordance with the sixth data signal data6.

Figure 8C:
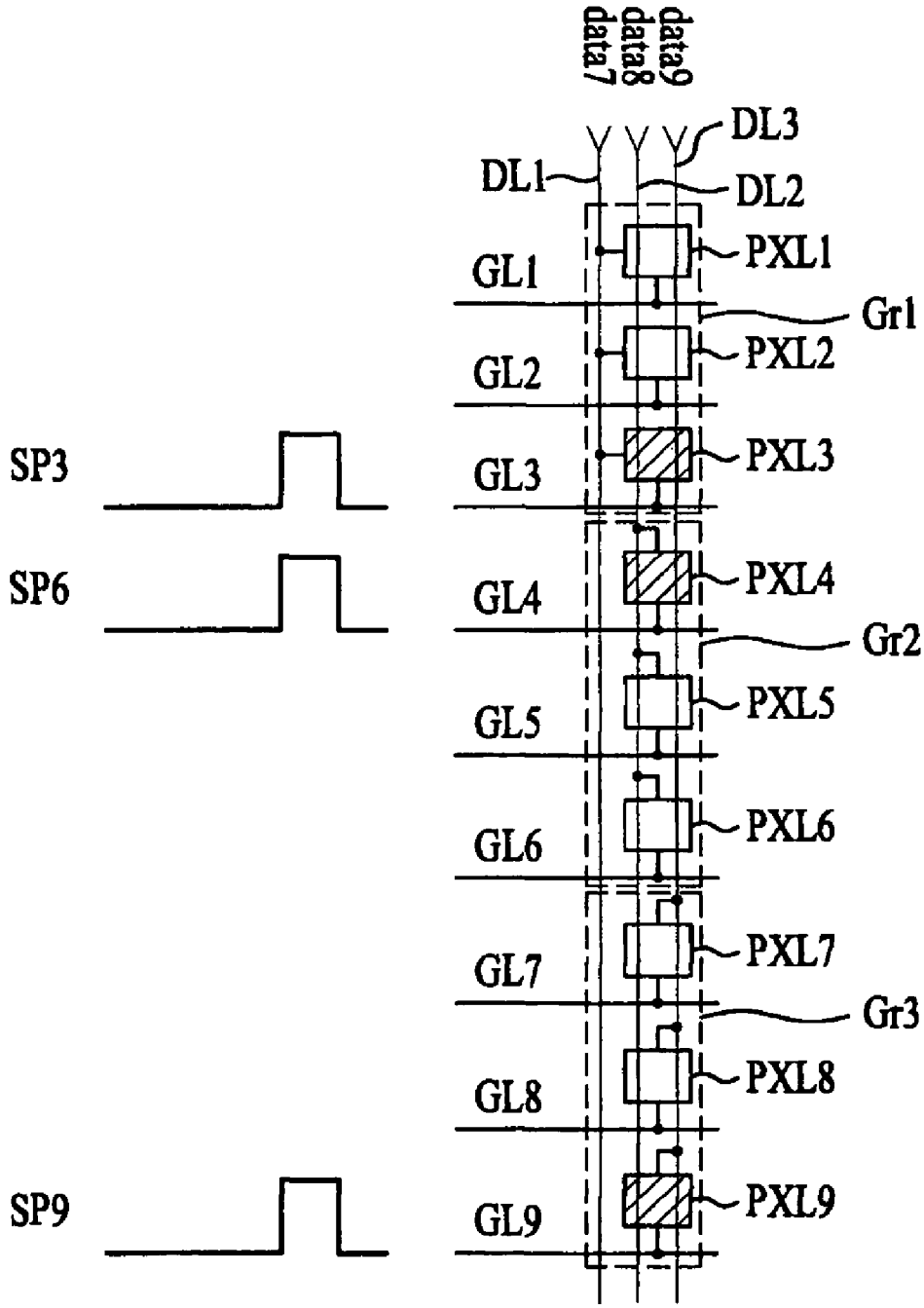
FIG. 8C illustrates an operation of a column of pixel cells during a third scan period in accordance with the scanning pattern shown in FIG. 7; and, FIG. 9 illustrates a dim effect removal at the boundaries of pixel cell groups in the display device according to an embodiment of the present invention.

FIG. 8C illustrates an operation of a column of pixel cells during a third scan period in accordance with the scanning pattern shown in FIG. 7. As shown in FIG. 8C, the gate driver 201 concurrently outputs the third, sixth and ninth scan pulses SP3, SP6 and SP9 during a third scan period. Accordingly, the third scan pulse SP3 is supplied to the third gate line GL3, the sixth scan pulse SP6 is supplied to the fourth gate line GL4, and the ninth scan pulse SP9 is supplied to the ninth gate line GL9. Accordingly, the third, fourth and ninth gate lines GL3, GL4 and GL9 are concurrently driven.

The third pixel cell PXL3 connected to the third gate line GL3, the fourth pixel cell PXL4 connected to the fourth gate line GL4, and the ninth pixel cell PXL9 connected to the ninth gate line GL9 are concurrently driven. Thus, the respective thin film transistors TFT of the third, fourth and ninth pixel cells PXL3, PXL4 and PXL9 are turned-on at the same time.

The data driver 202 outputs the seventh to ninth data signals data7 to data9 at the same time. Accordingly, the seventh data signal data7 is supplied to the first data line DL1, the eighth data signal data8 is supplied to the second data line DL2, and the ninth data signal data9 is supplied to the third data line DL3.

Then, the seventh data signal data7 charged in the first data line DL1 is supplied to the third pixel cell PXL3, which is connected to the first data line DL1, and the thin film transistor TFT of which is turned-on. Thus, the seventh data signal data7 is supplied to the pixel electrode PE of the third pixel cell PXL3 through the turned-on thin film transistor TFT of the third pixel cell PXL3. Accordingly, the third pixel cell PXL3 displays images in accordance with the seventh data signal data7.

The eighth data signal data8 charged in the second data line DL2 is supplied to the fourth pixel cell PXL4, which is connected to the second data line DL2, and the thin film transistor TFT of which is turned-on. Thus, the eighth data signal data8 is supplied to the pixel electrode PE of the fourth pixel cell PXL4 through the turned-on thin film transistor TFT. Accordingly, the fourth pixel cell PXL4 displays images in accordance the eighth data signal data8.

The ninth data signal data9 charged in the third data line DL3 is supplied to the ninth pixel cell PXL9, which is connected to the third data line DL3, and the thin film transistor TFT of which is turned-on. Thus, the ninth data signal data9 is supplied to the pixel electrode PE of the ninth pixel cell PXL9 through the turned-on thin film transistor TFT. Accordingly, the ninth pixel cell PXL9 displays images in accordance with the ninth data signal data9.

In an embodiment, the first to ninth data signals data1 to data9 are R data signals for displaying the red color. Accordingly, the first sub frame is completed at the end of the third scan period. During the first sub frame, the backlight unit 204 emits red light.

The one frame period can be completed by completing the processing of the second and third sub frames in a similar manner. For example, G data signals for displaying green color are supplied to the first to third data lines DL1 to DL3 during the second sub frame. Accordingly, the backlight unit 204 emits green light during the second sub frame when G data signals are received. Similarly, B data signals for displaying blue color are supplied to the first to third data lines DL1 to DL3 during the third sub frame. Accordingly, the backlight unit 204 emits blue light during the third sub frame when B data signals are received.

In accordance with embodiments of the present invention, the gate lines GL1 to GL9 are divided into the pixel cell groups Gr1 to Gr3, and then the gate lines in each pixel cell group are concurrently driven. Accordingly, it is possible to increase the scan time for each gate line GL.

The scan time for each gate line GL increases as the number of pixel cell groups increases. Specifically, if the number of concurrently driven gate lines increases, the scan time for each gate line increases accordingly. For example, in the case of the related art display device, each gate line (GL1 to GL9) is scanned for one horizontal time period to drive nine gate lines GL during one sub frame, one sub frame corresponding to nine horizontal time periods. In contrast, in a display device according to embodiments of the present invention, each gate line is scanned for three horizontal time periods to drive the nine gate lines GL1 to GL9 during one sub frame. Thus, the scan time for each gate line increases three times in the display device that conforms to embodiments of the present invention compared to the related art display device.

Accordingly, the scan time for each gate line in the display device according to embodiments of the present invention is three times as long as the related art. Eventually, the turn-on time of the thin film transistor TFT provided in each pixel cell PXL of the display device according to embodiments of the present invention is three times as long as the related art. In this respect, even though the size of the thin film transistor TFT is not large, sufficient charge time is provided for each pixel cell PXL.

In the display device according to embodiments of the present invention, the gate lines positioned at the boundaries of the pixel cell groups Gr1 to Gr3 are concurrently driven. Accordingly, the pixel cells connected to the gate lines of the boundaries are concurrently driven. Thus, the pixel cells positioned at the boundaries of the pixel cell groups have similar charge time. Accordingly, luminance difference between adjacent pixel cells is reduced.

Figure 9:
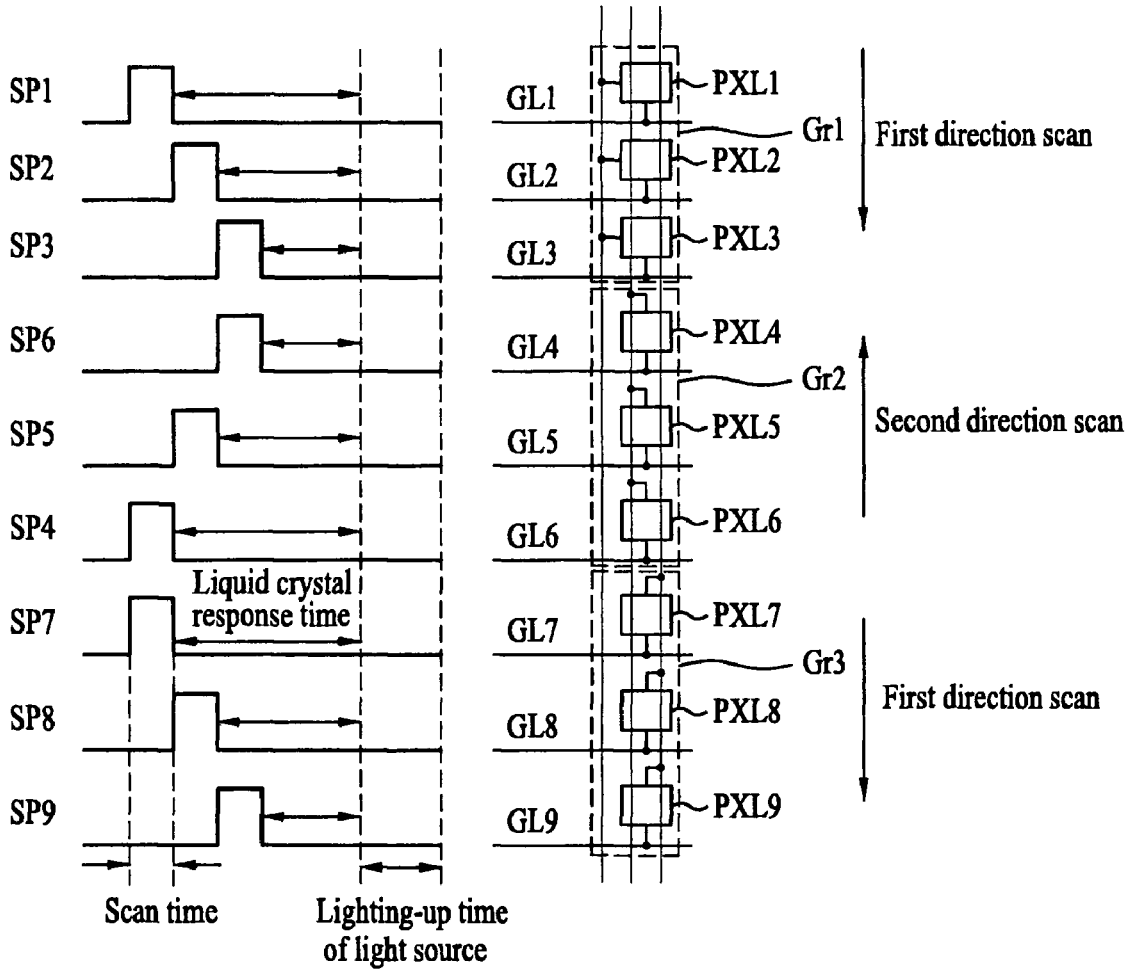

FIG. 9 illustrates a dim effect removal at the boundaries of pixel cell groups in the display device according to an embodiment of the present invention. As shown in FIG. 9, the gate lines GL1 to GL3 of the first pixel cell group Gr1 are scanned in the first scan direction from the first gate line GL1 to the last gate line GL3 in the first pixel cell group Gr1. Similarly, the gate lines GL7 to GL9 of the third pixel cell group Gr3 are scanned in the first scan direction from the first gate line GL7 to the last gate line GL9 in the third pixel cell group Gr3. In contrast, the gate lines GL4 to GL6 of the second pixel cell group Gr2 are scanned in the second, reverse scan direction from the last gate line GL6 to the first gate line GL4 in the second pixel cell group Gr2.

In this case, the corresponding gate lines positioned at respective boundaries of the pixel cell groups Gr1 to Gr3 are concurrently driven. For example, gate line GL3, which is the last gate line from the first pixel cell group Gr1, and gate line GL4, which is the first gate line from the second pixel cell group Gr2, are concurrently driven. Accordingly, pixel cell PXL3 and pixel cell PXL4 at a boundary of the first pixel cell group Gr1 with the second pixel cell group Gr2 have substantially the same liquid crystal response time. Similarly, gate line GL6, which is the third gate line from the second pixel cell group Gr2, and gate line GL7, which is the first gate line from the third pixel cell group Gr3, are concurrently driven. Accordingly, sixth pixel cell PXL6 and seventh pixel cell PXL7 at a boundary of the second pixel group Gr2 with the third pixel cell group Gr3 have substantially the same liquid crystal response time.

In embodiments of the present invention, a difference in luminance between adjacent pixels at the boundaries of adjacent pixel cell groups is prevented. Accordingly, a dim effect at the boundaries of adjacent pixel cell groups is prevented.

It will be apparent to those skilled in the art that various modifications and variations can be made in the display device and method for driving the same of the present invention without departing from the spirit or scope of the invention. Thus, it is intended that the present invention covers the modifications and variations of this invention provided they come within the scope of the appended claims and their equivalents.

What is claimed is:

1. A display device, comprising:

a plurality of pixel cells divided into a first to i-th pixel cell groups, wherein i is natural number more than 2;

a first to i-th data lines, each of the data lines connected to the each pixel cell group individually, wherein an p-th data line is connected to the pixel cells in an p-th pixel cell group, wherein p is a natural number smaller than i+1;

a gate driver driving at least one of the pixel cells in one pixel cell group concurrently with at least one of the pixel cells in another pixel cell group;

wherein the data lines have different lengths;

wherein the length of a q-th data line is such that the q-th data line overlaps above pixel electrodes of the pixel cells from the first to q-th pixel cell groups;

wherein q is a natural number greater than 1 and less than i+1;

wherein a portion of the pixel electrode overlapped by the data line is removed;

wherein the more q of the q-th data line increases, the more both length and width of the q-th data line increase;

wherein the gate driver drives pixel cells included in a (2n−1)-th pixel cell group in a first scan direction, and drives the pixel cells included in a (2n)-th pixel cell group in a second scan direction, where n is a natural number; and wherein the gate driver drives the pixel cells included in the (2n−1)-th pixel cell group sequentially according to an order of the pixel cells in the (2n−1)-th pixel cell group from a first one to a last one of the pixel cells in the (2n−1)-th pixel cell group, and the gate driver drives the pixel cells included in the (2n)-th pixel cell group sequentially according to a reverse order of the pixel cells in the (2n)-th pixel cell group from the last one to the first one of the pixel cells in the (2n)-th pixel cell group.

2. The display device of claim 1, wherein each of the pixel cell groups includes at least two pixel cells.

3. The display device of claim 2, wherein each pixel cell group has the same number of pixel cells.

4. The display device of claim 2, wherein a (2n−1)-th pixel cell group has a different number of pixel cells from a (2n)-th pixel cell group.

5. The display device of claim 1, wherein the gate driver drives one of the pixel cells in the (2n−1)-th pixel cell group concurrently with a corresponding one of the pixel cells in the (2n)-th pixel cell group.

6. The display device of claim 5, wherein the gate driver drives the first pixel cell in the (2n−1)-th pixel cell group concurrently with the last pixel cell in the (2n)-th pixel cell group.

7. The display device of claim 6, wherein the gate driver drives the m-th pixel cell in the (2n−1)-th pixel cell group concurrently with the (k−m+1)-th pixel cell in the (2n)-th pixel cell group, where m is a natural number and k is the number of pixel cells in the (2n)-th pixel cell group.

8. The display device of claim 1, wherein each pixel cell includes a switching device switching data from a data line in respond to scan pulse from the gate driver, a common electrode facing the pixel electrode, and liquid crystal between the pixel electrode and the common electrode, wherein the pixel electrode of the each pixel is provided with the data from the switching device.

9. The display device of claim 8, wherein the pixel electrode includes a plurality of transparent electrodes and at least one connection electrode connecting the plurality of transparent electrodes.

10. The display device of claim 9, wherein the data line overlaps the at least one connection electrode.

11. The display device of claim 1, wherein each pixel displays an image of red during a first sub frame, an image of green during a second sub frame, and an image of blue during a third sub frame, sequentially.

12. The display device of claim 11, further comprising a back light unit emitting red light during the first sub frame, green light during the second sub frame, and blue light during the third sub frame.

13. A display device, comprising:

a plurality of pixel cells divided into a first to i-th pixel cell groups, wherein i is natural number more than 2;

a data driver supplying data to the respective pixel cells in the first to i-th pixel cell groups;

a first to i-th data lines, each of the data lines connected to the each pixel cell group individually, wherein an p-th data line is connected to the pixel cells in an p-th pixel cell group, wherein p is a natural number smaller than i+1;

a gate driver driving the pixel cells in one pixel cell group sequentially according to an order of the pixel cells in the one pixel cell group from a first one to a last one of the pixel cells in the one pixel cell group, and driving the pixel cells in another pixel cell group sequentially according to a reverse order of the pixel cells in the another pixel cell group from a last one to a first one of the pixel cells in the another pixel cell group;

wherein the data lines have different lengths;

wherein the length of a q-th data line is such that the q-th data line overlaps above pixel electrodes of the pixel cells from the first to q-th pixel cell groups;

wherein q is a natural number greater than 1 and less than i+1;

wherein a portion of the pixel electrode overlapped by the data line is removed;

wherein the more q of the q-th data line increases, the more both length and width of the q-th data line increase.

14. The display device of claim 13, wherein the gate driver drives the pixel cells included in a (2n−1)-th pixel cell group sequentially according to an order of the pixel cells in the (2n−1)-th pixel cell group from a first one to a last one of the pixel cells in the (2n−1)-th pixel cell group, and the gate driver drives the pixel cells included in a (2n)-th pixel cell group sequentially according to a reverse order of the pixel cells in the (2n)-th pixel cell group from the last one to the first one of the pixel cells in the (2n)-th pixel cell group, where n is a natural integer.

15. The display device of claim 13, wherein the gate driver drives one of the pixel cells in the (2n−1)-th pixel cell group concurrently with a corresponding one of the pixel cells in the (2n)-th pixel cell group.

16. The display device of claim 15, wherein the gate driver drives the first pixel cell in the (2n−1)-th pixel cell group concurrently with the last pixel cell in the (2n)-th pixel cell group.

17. The display device of claim 13, wherein each of the plurality of pixel cells includes a switching device switching data from a data line in response to a scan pulse from the gate driver, a common electrode facing the pixel electrode, and a liquid crystal between the pixel electrode and the common electrode, wherein the pixel electrode of the each pixel is provided with the data from the switching device.

18. The display device of claim 17, wherein the pixel electrode includes a plurality of transparent electrodes and at least one connection electrode connecting the transparent electrodes.

19. The display device of claim 18, wherein the data line overlaps the at least one connection electrode.

20. The display device of claim 13, wherein each pixel displays an image of red during a first sub frame, an image of green during a second sub frame, and an image of blue during a third sub frame, sequentially.

21. The display device of claim 20, further comprising a back light unit emitting red light during the first sub frame, green light during the second sub frame, and blue light during the third sub frame.

* * * * *